US010589529B2

(12) United States Patent
Suzuki et al.

(10) Patent No.: US 10,589,529 B2
(45) Date of Patent: Mar. 17, 2020

(54) PRINTING APPARATUS AND PRINTING METHOD

(71) Applicant: SEIKO EPSON CORPORATION, Tokyo (JP)

(72) Inventors: Kazunaga Suzuki, Azumino (JP); Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/155,752

(22) Filed: Oct. 9, 2018

(65) Prior Publication Data

US 2019/0105906 A1 Apr. 11, 2019

(30) Foreign Application Priority Data

Oct. 10, 2017 (JP) ..... 2017-196623

(51) Int. Cl.

| | |
|---|---|
| ***B41J 2/165*** | (2006.01) |
| ***B41J 11/00*** | (2006.01) |
| ***B41J 2/17*** | (2006.01) |
| *B41J 2/01* | (2006.01) |

(52) U.S. Cl.

CPC ..... *B41J 2/16538* (2013.01); *B41J 2/1714* (2013.01); *B41J 11/002* (2013.01); *B41J 2/01* (2013.01)

(58) Field of Classification Search

CPC ..... B41J 11/002; B41J 11/0015; B41J 2/01; B41J 2/1714; B29C 2035/0827

See application file for complete search history.

(56) References Cited

U.S. PATENT DOCUMENTS

| | | | | |
|---|---|---|---|---|
| 6,646,278 | B1 * | 11/2003 | Schwarz | B05D 3/067 250/504 R |
| 2005/0190224 | A1 * | 9/2005 | Yokoyama | B41J 11/002 347/17 |
| 2008/0230721 | A1 * | 9/2008 | Matsushita | H01L 21/67115 250/492.2 |
| 2008/0239044 | A1 * | 10/2008 | Yokota | B41J 11/002 347/102 |
| 2016/0167399 | A1 | 6/2016 | Ohnishi | |

FOREIGN PATENT DOCUMENTS

| | | |
|---|---|---|
| JP | 2004-358753 | 12/2004 |
| JP | 2015-009376 | 1/2015 |

* cited by examiner

*Primary Examiner* — John Zimmermann
(74) *Attorney, Agent, or Firm* — Workman Nydegger

(57) ABSTRACT

A printing apparatus includes: a head including a nozzle disposed on a nozzle surface and configured to discharge ultraviolet-curable ink onto a recording medium; first and second irradiation units as an ultraviolet irradiation unit configured to irradiate the ultraviolet-curable ink discharged onto the recording medium with an ultraviolet ray; and a smoke supply unit configured to supply smoke to a part of an advancing path from the first and second irradiation units to the nozzle surface of an ultraviolet ray irradiated from the first and second irradiation units and entering the nozzle surface.

11 Claims, 18 Drawing Sheets

PRINTING APPARATUS AND PRINTING METHOD

BACKGROUND

1. Technical Field

The invention relates to a printing apparatus and a printing method.

2. Related Art

In the related art, there is known a printing apparatus configured to record an image, a text and the like by using ultraviolet-curable ink curing and changing from a liquid to a solid by ultraviolet ray irradiation to form a plurality of dots on a recording medium. In the printing apparatus using the ultraviolet-curable ink, the ink in a nozzle is cured by an ultraviolet ray entering a nozzle surface of a head to cause nozzle clogging, ink mist deposited on the nozzle surface is thickened, and the thickened ink blocks a nozzle opening when the nozzle surface is wiped. Thus, the ink cannot be discharged normally, and so-called nozzle omission has been an issue. For example, JP-A-2004-358753 discloses an ink jet printer (printing apparatus) including a mask plate provided on a nozzle surface. The mask plate functions as a light-shielding plate, and this mask plate prevents an ultraviolet ray from entering the nozzle surface from an ultraviolet lamp.

An ultraviolet ray emitted from an ultraviolet irradiation unit (ultraviolet lamp) is reflected and scattered by a platen and a recording medium, and further, the reflective light and the scattering light are repeatedly reflected and scattered by a member around a head. Similarly, in a printing apparatus described in JP-A-2004-358753, the ultraviolet ray turned into the reflective light and the scattering light reaches the nozzle surface from a gap between the mask plate and the recording medium, and failures in ink discharge occurs over time owing to nozzle clogging and the like. As a result, printing quality may deteriorate.

SUMMARY

Some aspects of the invention address at least some of the above-described issues, and can be realized as the following modes or application examples.

Application Example 1

A printing apparatus according to the application example includes a head including a nozzle disposed on a nozzle surface and configured to discharge ultraviolet-curable ink onto a recording medium, an ultraviolet irradiation unit configured to irradiate the ultraviolet-curable ink discharged onto the recording medium with an ultraviolet ray, and a smoke supply unit configured to supply smoke to a part of an advancing path, from the ultraviolet irradiation unit to the nozzle surface, of an ultraviolet ray irradiated from the ultraviolet irradiation unit and entering the nozzle surface.

According to the application example, the printing apparatus includes the smoke supply unit configured to supply smoke. The smoke supply unit supplies smoke to a part of the advancing path, from the ultraviolet irradiation unit to the nozzle surface, of an ultraviolet ray entering the nozzle surface, and thus, a curtain of the smoke shielding the ultraviolet ray is formed in an area between the ultraviolet irradiation unit and the nozzle surface. The ultraviolet ray entering the nozzle surface is shielded by this curtain of the smoke and thus, failures in ink discharge due to nozzle clogging (nozzle omission) and the like are suppressed. Therefore, a printing apparatus having improved printing quality can be provided.

Application Example 2

In the printing apparatus according to the above-described application example, the smoke supply unit may supply the smoke to a region on the advancing path other than a region between the ultraviolet irradiation unit and the recording medium.

According to the application example, the smoke supply unit supplies the smoke to the region other than the region between the ultraviolet irradiation unit and the recording medium and thus, the ultraviolet ray entering the nozzle surface can be shielded without impeding curing of the ultraviolet-curable ink discharged onto the recording medium.

Application Example 3

In the printing apparatus according to the above-described application example, the smoke supply unit may include a smoke generation unit configured to generate the smoke and a fan configured to blow the smoke.

According to the application example, the smoke supply unit includes the fan and thus, the smoke supply unit can efficiently supply the smoke generated by the smoke generation unit.

Application Example 4

In the printing apparatus according to the above-described application example, the smoke supply unit may be coupled to a supply port configured to eject the smoke, and the supply port may be located between the ultraviolet irradiation unit and the head.

According to the application example, the smoke supply unit is coupled to the supply port located between the ultraviolet irradiation unit and the head, and thus, the smoke supply unit can suitably supply smoke in a vicinity of the nozzle surface.

Application Example 5

The printing apparatus according to the above-described application example may include a first partition wall disposed to face a first side surface of the head facing the ultraviolet irradiation unit, a second partition wall disposed to face a second side surface facing the first side surface of the head, and a smoke collection unit configured to collect the smoke. The smoke supply unit may be coupled to a supply port configured to eject the smoke and the supply port may be located between the first side surface and the first partition wall in a plan view. The smoke collection unit may be coupled to a suction port configured to suck the smoke and the suction port may be located between the second side surface and the second partition wall in a plan view.

According to the application example, the smoke supply unit is coupled to the supply port located between the first side surface of the head facing the ultraviolet irradiation unit and the first partition wall. The smoke collection unit is coupled to the suction port located between the second side surface of the head facing the first side surface and the second partition wall. In other words, the supply port, the head, and the suction port are disposed in order of the supply port, the head, and the suction port from an ultraviolet irradiation unit side. The smoke moves from the supply port, passes through the nozzle surface of the head toward the suction port and is sucked through the suction port, and thus, the smoke does not intrude to the ultraviolet irradiation unit side. Accordingly, the ultraviolet ray entering the nozzle surface can be shielded without impeding curing of the ultraviolet-curable ink discharged onto the recording medium.

Application Example 6

The printing apparatus according to the above-described application example may include a first partition wall, a second partition wall, a smoke collection unit configured to collect the smoke, a first supply port and a second supply port coupled to the smoke supply unit and configured to eject the smoke, and a first suction port and a second suction port coupled to the smoke collection unit and configured to suck the smoke. The ultraviolet irradiation unit may include a first irradiation unit provided on one side of the head in a first direction and a second irradiation unit provided on the other side of the head in the first direction. The head may reciprocate in the first direction, the first partition wall may be disposed between the first irradiation unit and the head to face a first side surface of the head, and the second partition wall may be disposed between the second irradiation unit and the head to face a second side surface of the head. The first supply port and the first suction port may be located between the first side surface and the first partition wall in a plan view from a vertical direction, and the second supply port and the second suction port may be located between the second side surface and the second partition wall in a plan view from the vertical direction.

According to the application example, the first irradiation unit is provided on the one side of the head in the first direction in which the head reciprocates, and the second irradiation unit is provided on the other side of the head in the first direction. Furthermore, the first supply port and the first suction port are located between the first side surface as the one side of the head and the first partition wall, and the second supply port and the second suction port are located between the second side surface as the other side of the head and the second partition wall. An ultraviolet ray irradiated from the first irradiation unit and entering the nozzle surface is shielded by the smoke ejected through the second supply port and to be sucked through the first suction port. An ultraviolet ray irradiated from the second irradiation unit and entering the nozzle surface is shielded by the smoke ejected through the first supply port and to be sucked through the second suction port. Accordingly, the ultraviolet rays irradiated from the first and second irradiation units and entering the nozzle surface can be shielded, and failures in ink discharge due to nozzle omission and the like can be suppressed.

Application Example 7

The printing apparatus according to the above-described application example may include a first switching unit configured to switch between supplying the smoke through the first supply port and supplying the smoke through the second supply port, a second switching unit configured to switch between sucking the smoke through the first suction port and sucking the smoke through the second suction port, and a control unit configured to control the first switching unit and the second switching unit. The control unit may control the first switching unit and the second switching unit to supply the smoke through the first supply port and suck the smoke through the second suction port, when the head moves from the other side to the one side in the first direction, and may control the first switching unit and the second switching unit to supply the smoke through the second supply port and suck the smoke through the first suction port, when the head moves from the one side to the other side in the first direction.

According to the application example, when the head moves from the other side to the one side, the control unit controls the first and second switching units to supply the smoke through the first supply port and suck the smoke through the second suction port. Furthermore, when the head moves from the one side to the other side, the control unit controls the first and second switching units to supply the smoke through the second supply port and suck the smoke through the first suction port. That is, in a movement direction of the head, the smoke is ejected downstream of the head and sucked upstream of the head moving downstream. Then, the ultraviolet-curable ink discharged onto the recording medium is cured by the ultraviolet irradiation unit provided further upstream of the head. Accordingly, the ultraviolet rays irradiated from the first and second irradiation units and entering the nozzle surface are shielded by the smoke. Furthermore, the smoke is suitably collected upstream of the head moving downstream and collected downstream of the ultraviolet irradiation unit and thus, the smoke does not impede irradiation with the ultraviolet ray curing the ultraviolet-curable ink.

Application Example 8

The printing apparatus according to the above-described application example may include a carriage configured to hold the head and the smoke supply unit may be held by the carriage.

According to the application example, the smoke supply unit is held by the carriage configured to hold the head. Accordingly, the smoke supply unit can move together with the head.

Application Example 9

The printing apparatus according to the above-described application example may include a carriage configured to hold the ultraviolet irradiation unit and the smoke supply unit may be held by the carriage.

According to the application example, the smoke supply unit is held by the carriage configured to hold the ultraviolet irradiation unit. Accordingly, the smoke supply unit can move together with the ultraviolet irradiation unit.

Application Example 10

In the printing apparatus according to the above-described application example, the smoke supply unit may be provided at a position isolated from the head and the ultraviolet irradiation unit, and the smoke may be supplied via a smoke supply tube.

According to the application example, the smoke is supplied via the smoke supply tube by the smoke supply unit provided at the position isolated from the ultraviolet irradiation unit, to a part of the advancing path, from the ultraviolet irradiation unit to the nozzle surface, of the ultraviolet ray entering the nozzle surface. Accordingly, a degree of freedom of an installation location of the smoke supply unit increases.

Application Example 11

A printing method of a printing apparatus according to the application example is a printing method of a printing apparatus including a head including a nozzle disposed on a nozzle surface and configured to discharge ultraviolet-curable ink onto a recording medium, an ultraviolet irradiation unit configured to irradiate the ultraviolet-curable ink discharged onto the recording medium with an ultraviolet ray, and a smoke supply unit configured to supply smoke to a part of an advancing path, from the ultraviolet irradiation unit to the nozzle surface, of an ultraviolet ray irradiated from the ultraviolet irradiation unit and entering the nozzle surface. The method includes supplying the smoke from the smoke supply unit, emitting an ultraviolet ray from the ultraviolet irradiation unit, and performing main scanning for discharging ultraviolet-curable ink from the head.

According to the application example, the printing method of a printing apparatus includes the smoke supply step of supplying the smoke from the smoke supply unit. In the smoke supply step, the smoke is supplied from the smoke supply unit to a part of the advancing path, from the ultraviolet irradiation unit to the nozzle surface, of the ultraviolet ray entering the nozzle surface, and a curtain of the smoke shielding the ultraviolet ray is formed in an area between the ultraviolet irradiation unit and the nozzle surface. The ultraviolet ray entering the nozzle surface is shielded by this curtain of the smoke and thus, failures in ink discharge due to nozzle omission and the like are suppressed. Therefore, the printing method capable of improving printing quality of the printing apparatus can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary Embodiments of the invention will be described below with reference to the drawings. Note that, in each of the figures below, to illustrate each of members and the like in a recognizable size, each of the members and the like is illustrated to a scale different from an actual scale.

Furthermore, in FIG. 1 to FIG. 6, FIG. 11 to FIG. 15, and FIG. 20 to FIG. 24, for simplicity, an X-axis, a Y-axis, and a Z-axis are illustrated as three axes perpendicular to one another, and a leading end side of an arrow indicating an axial direction is referred to as a "+ side", and a trailing end side is referred to as a "− side". Furthermore, a direction parallel to the X-axis is referred to as an "X-axis direction" or a "main scanning direction", a direction parallel to the Y-axis is referred to as a "Y-axis direction" or a "sub scanning direction", and a direction parallel to the Z-axis is referred to as a "Z-axis direction" below.

Exemplary Embodiment 1

Printing Apparatus

Figure 1:
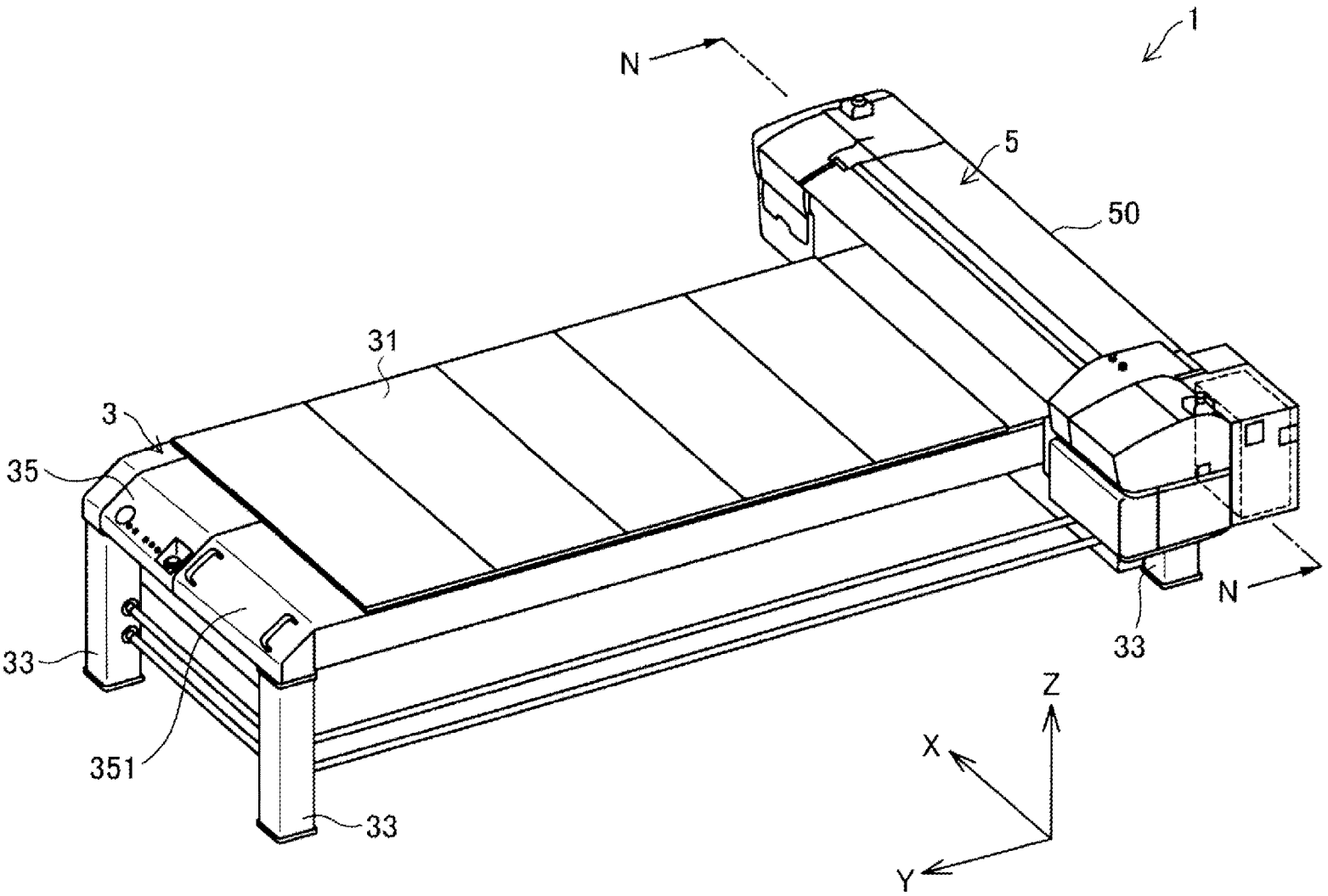
FIG. 1 is a schematic perspective view illustrating a schematic configuration of a printing apparatus according to Exemplary Embodiment 1.

FIG. 1 is a schematic perspective view illustrating a schematic configuration of a printing apparatus according to Exemplary Embodiment 1.

Firstly, a schematic configuration of a printing apparatus 1 will be described with reference to FIG. 1.

Figure 9:
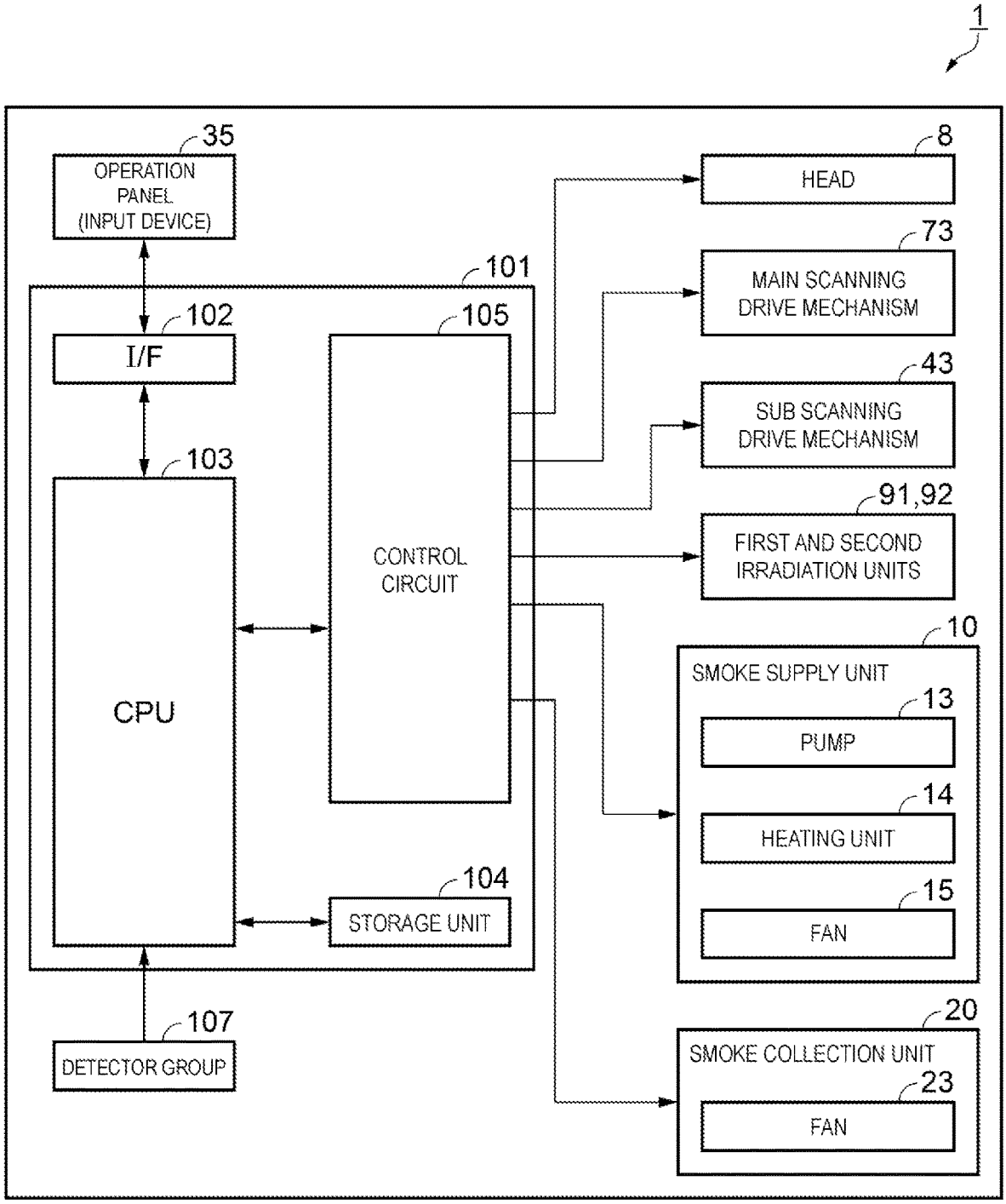
FIG. 9 is an electric block diagram illustrating an electrical configuration of a printing apparatus.

As illustrated in FIG. 1, the printing apparatus 1 is configured to include a printing processing unit 5 covered with a housing member 50, a support stage 3, an operation panel 35, an opening/closing door 351, a leg 33, and a control unit 101 provided inside the printing apparatus 1 (see FIG. 9). The printing apparatus 1 in the exemplary embodiment includes an ink jet printer configured to discharge ultraviolet-curable ink (also referred to as "UV ink" below) in a droplet form onto a recording medium to record a text, a graphic, an image and the like.

The printing apparatus 1 includes a so-called flat bed type printer in which ultraviolet-curable ink is cured by an ultraviolet ray irradiated from the printing processing unit 5, and is discharged onto a recording medium horizontally supported by the support stage 3 to perform printing. As the recording medium, paper, cloth, a film, a metal, and the like can be used.

The support stage 3 has a substantially flat plate shape longer in the Y-axis direction (sub scanning direction) than in the X-axis direction (main scanning direction). During printing, the recording medium is disposed on the support stage 3. A placing surface 31 coming into contact with the recording medium on the support stage 3 is provided with a plurality of suction holes (not illustrated) enabling the recording medium to be stuck and held on the placing surface. Note that the method of holding the recording medium is exemplary, and is not limited to the above method.

The leg 33 is provided at each of four corners of the support stage 3, and supports the support stage 3. The leg 33 may include a beam configured to couple the legs to one another to increase strength, and a caster configured to facilitate movement of the printing apparatus 1.

The operation panel 35 is an input device configured to receive an instruction from an operator. The opening/closing door 351 is an input device used by an operator to manually perform maintenance of the printing processing unit 5. The printing processing unit 5 moves immediately above the opening/closing door 351 (to the + side in the Z-axis direction), and accordingly, an operator can open the opening/closing door 351 to manually perform maintenance of an inside of the printing processing unit 5.

Figure 2:
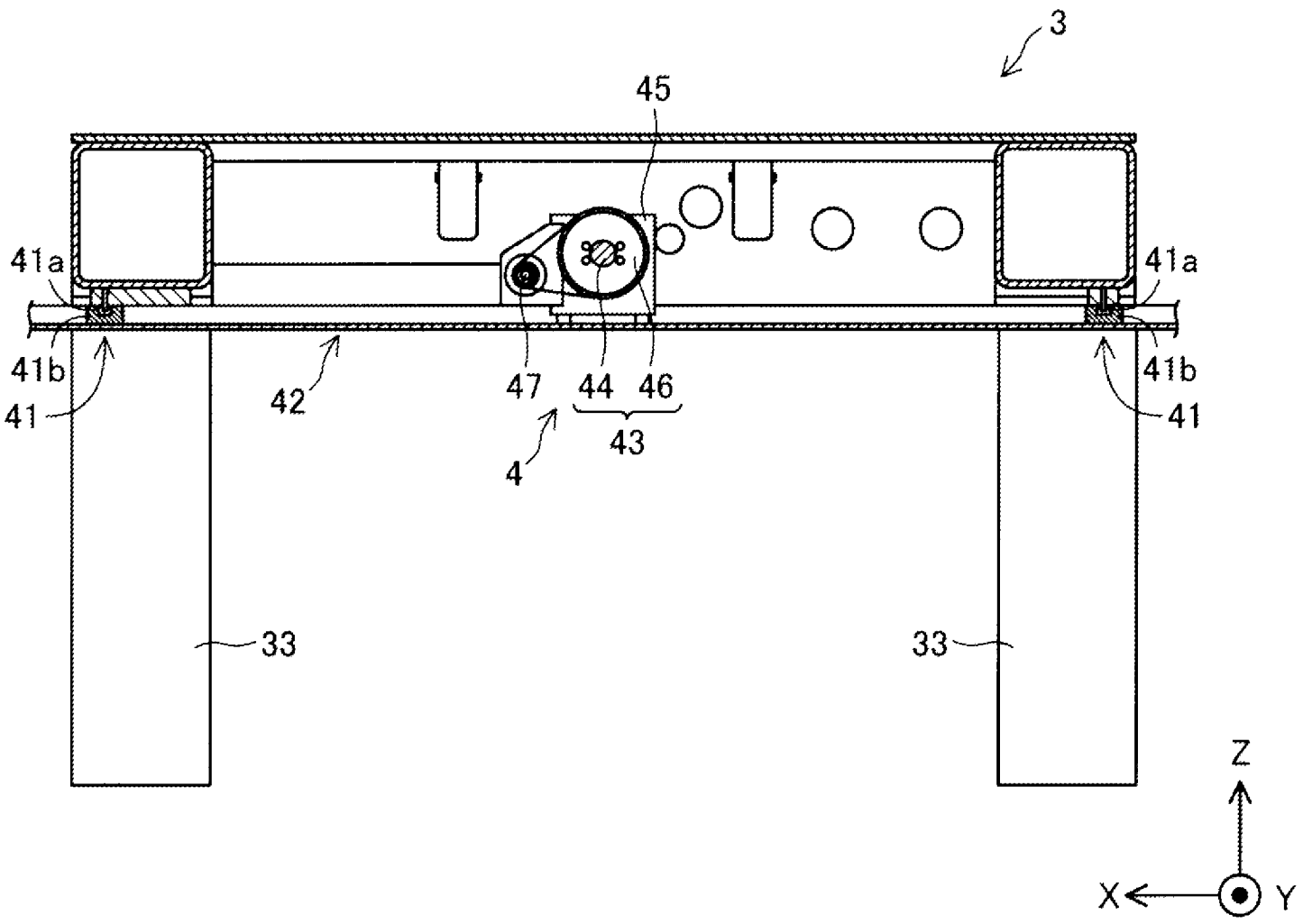
FIG. 2 is a cross-sectional view along line N-N in FIG. 1.

FIG. 2 is a cross-sectional view along line N-N in FIG. 1. FIG. 2 illustrates a cross section of the support stage 3, and illustration of the printing processing unit 5 attached to a linking frame 42 described below is omitted in FIG. 2. As illustrated in FIG. 2, the support stage 3 includes a sub scanning unit 4 configured to relatively move a head 8 described below relative to the recording medium along the sub scanning direction (Y-axis direction) intersecting with the main scanning direction (X-axis direction) to perform sub scanning. The sub scanning unit 4 includes a pair of guide mechanisms 41 provided on both sides of the support stage 3 in the main scanning direction (X-axis direction), the linking frame 42 configured to link the printing processing unit 5 not illustrated (see FIG. 1) and the guide mechanism 41, and a sub scanning drive mechanism 43 configured to drive the printing processing unit 5 not illustrated (see FIG. 1) along the guide mechanism 41 in the sub scanning direction (Y-axis direction).

In the exemplary embodiment, the guide mechanism 41 includes an LM guide (trade name) (Linear Motion Guide). The guide mechanism 41 includes a guide rail 41*a* extending in the sub scanning direction (Y-axis direction) and fixed below the support stage 3, and a slider 41*b* configured to slide along the guide rail 41*a* in the sub scanning direction (Y-axis direction). The slider 41*b* is attached via the linking frame 42 to the printing processing unit 5 not illustrated (see FIG. 1).

The sub scanning drive mechanism 43 includes a screw shaft 44 extending in the sub scanning direction (Y-axis direction) and fixed to the support stage 3, a nut member 46 configured to be screwed into the screw shaft 44, a sub scanning motor 47 configured to rotate the nut member 46, and a support member 45 attached to the linking frame 42 to enable the nut member 46 to freely rotate. The sub scanning unit 4 can rotate the nut member 46 by the sub scanning motor 47 to move the printing processing unit 5 not illustrated (see FIG. 1) together with the linking frame 42 in the sub scanning direction (Y-axis direction).

Figure 3:
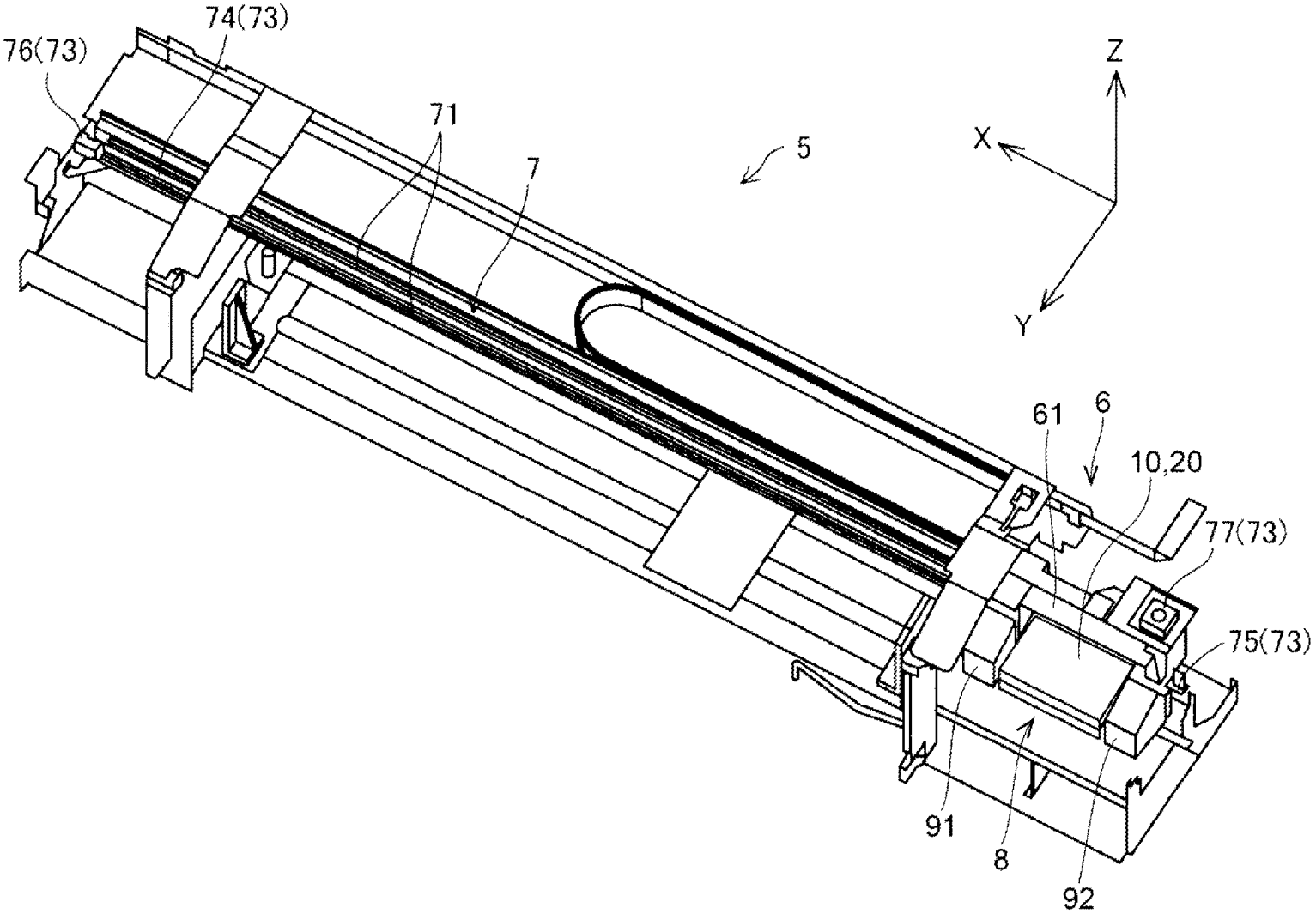
FIG. 3 is a perspective view illustrating an inside of a printing processing unit.
Figure 4:
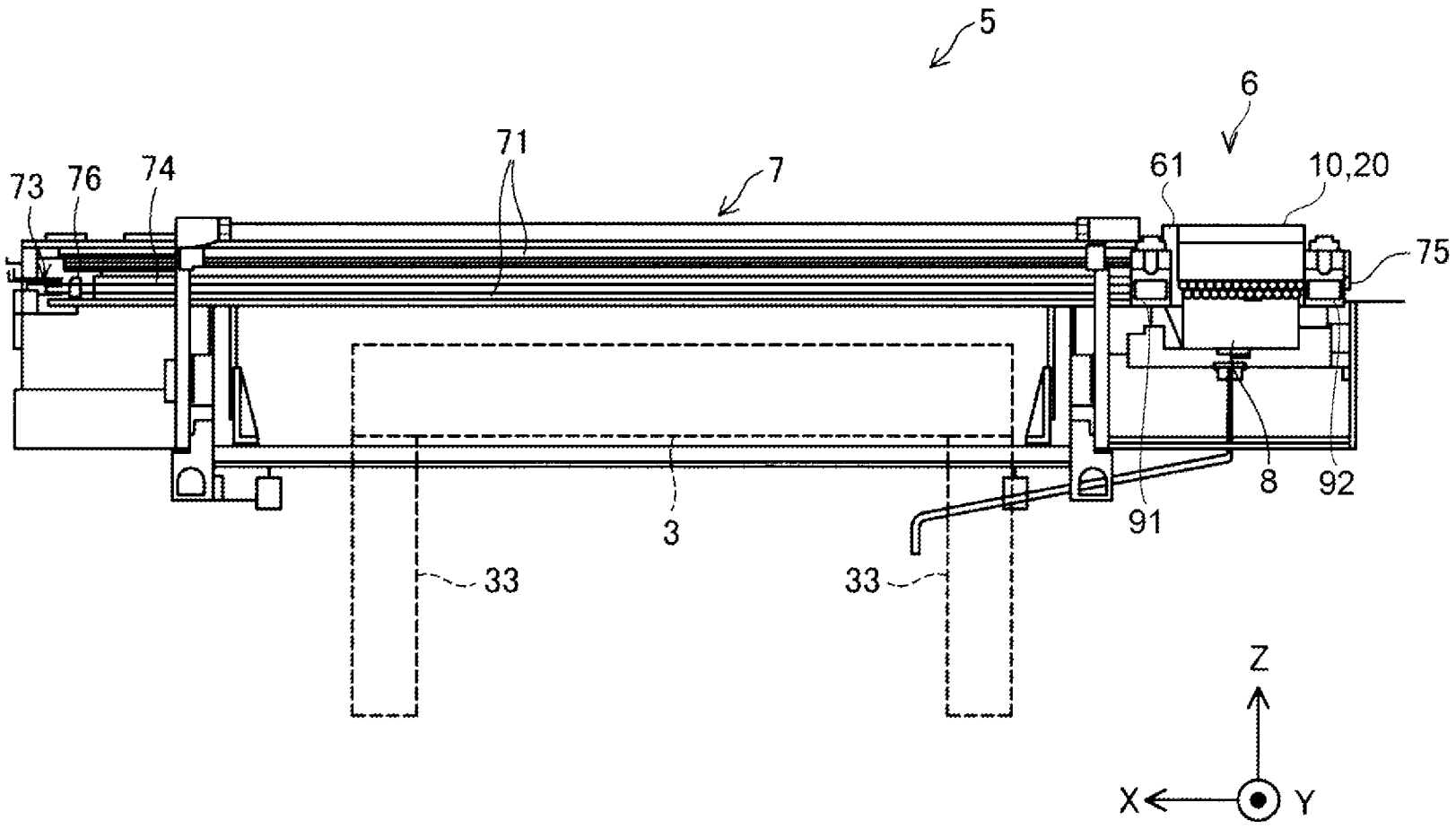
FIG. 4 is a side view illustrating the inside of the printing processing unit.

FIG. 3 is a perspective view illustrating an inside of the printing processing unit in FIG. 1. FIG. 4 is a side view illustrating the inside of the printing processing unit in FIG. 1. Note that in FIG. 3, for simplicity, the inside of the housing member 50 (see FIG. 1) is illustrated. As illustrated in FIG. 3 and FIG. 4, the printing processing unit 5 includes a printing unit 6 in which the head 8 and the like are mounted, a main scanning unit 7 configured to relatively move the head 8 relative to the recording medium along the main scanning direction (X-axis direction) to perform main scanning, and the housing member 50 not illustrated (see FIG. 1) configured to house the printing unit 6 and the main scanning unit 7.

The main scanning unit 7 includes a pair of upper and lower guide shafts 71 configured to support the printing unit 6 to enable the printing unit 6 to move in the main scanning direction (X-axis direction), and a main scanning drive mechanism 73 configured to enable the printing unit 6 to move along the guide shafts 71.

The main scanning drive mechanism 73 includes a timing belt 74 extending along the guide shafts 71 in the main scanning direction (X-axis direction), a driving pulley 75 and a driven pulley 76 configured to bridge the timing belt 74, and a main scanning motor 77 configured to drive the driving pulley 75. The main scanning unit 7 can drive the driving pulley 75 by the main scanning motor 77 to reciprocate the printing unit 6 including the head 8 linked to the timing belt 74, in the main scanning direction (to the + side and the − side in the X-axis direction) as a first direction.

Figure 5:
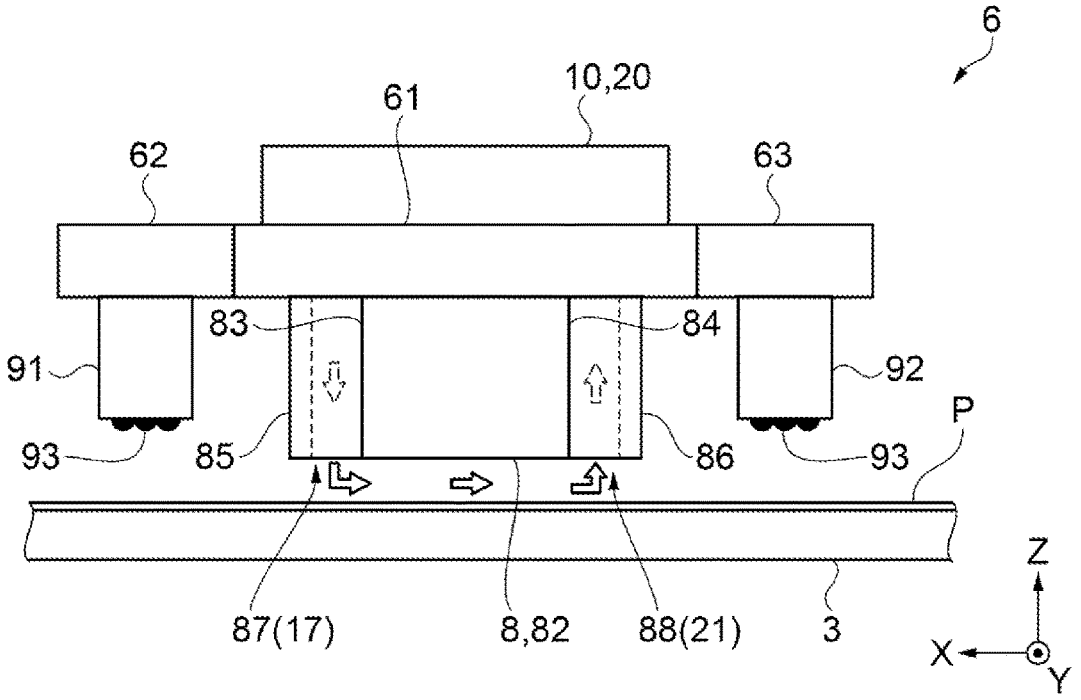
FIG. 5 is a side view illustrating a configuration of a printing unit.
Figure 6:
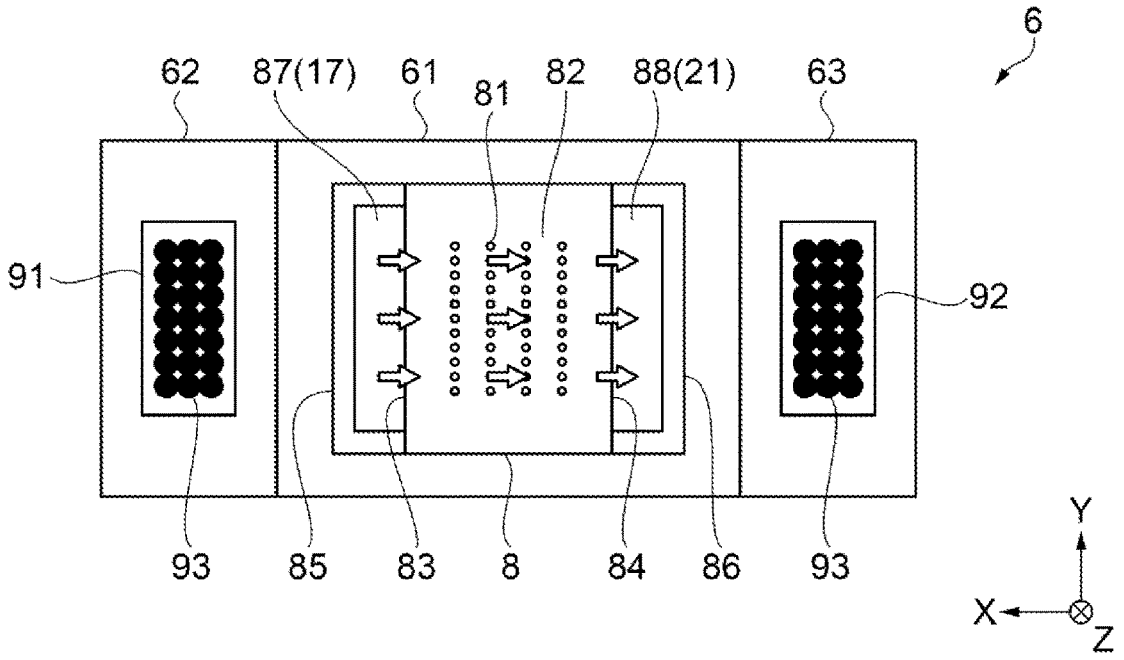
FIG. 6 is a plan view illustrating the configuration of the printing unit.

FIG. 5 is a side view illustrating a configuration of the printing unit. FIG. 6 is a plan view illustrating the configuration of the printing unit. Next, a configuration of the printing unit 6 will be described with reference to FIG. 5 and FIG. 6.

The printing unit 6 includes the head 8, first and second irradiation units 91 and 92 as an ultraviolet irradiation unit, a smoke supply unit 10, a smoke collection unit 20, and the like. Furthermore, the printing unit 6 includes a carriage 61 configured to hold the head 8, a carriage 62 configured to hold the first irradiation unit 91, and a carriage 63 configured to hold the second irradiation unit 92. The carriages 61, 62, and 63 of the exemplary embodiment are formed integrally; however, each of the carriages 61, 62, and 63 may be provided individually. Furthermore, the carriages 61, 62, and 63 may be configured to be stuck to one another with a magnet and the like.

The head 8 includes a nozzle surface 82, and the nozzle surface 82 is provided with a nozzle 81 configured to discharge ultraviolet-curable ink (UV ink) onto a recording medium P. A plurality of ink cartridges (not illustrated) configured to house the UV ink of a predetermined color (for example, cyan (C), magenta (M), yellow (Y), and black (K)) are mounted in the carriage 61. The UV ink housed in the ink cartridges is supplied to the head 8. Furthermore, the head 8 includes a plurality of nozzles 81 configured to discharge the UV ink toward the recording medium P, and an actuator (nozzle actuator) (not illustrated) provided to correspond to each of the plurality of nozzles 81. As the nozzle actuator, a piezoelectric actuator and a thermal actuator can be used. Noted that in the exemplary embodiment, the configuration where the printing unit 6 is provided with the one head 8 is described as an example; however, a printing unit including a head unit including a plurality of heads may be adopted. Furthermore, the UV ink may be supplied to the head 8 via an ink supply tube from an ink tank provided at a location other than the carriage 61.

The UV ink contains, as components, a resin material, a photoinitiator, and a solvent. A coloring matter such as a pigment and a dye, and a functional material such as a surface reforming material including a lyophilic material, a liquid repellent material, and the like are added to these components, and accordingly, the ink having a unique function can be produced. To the ink of yellow, cyan, magenta, and black for forming a color image, a coloring matter such as a pigment and a dye is added.

The resin material is a material for forming a resin film. The resin material is not particularly limited, as long as such a resin material is any material that is liquid at normal temperature and that results in a polymer by polymerization. The resin material may have low viscosity, and the resin material may have an oligomeric form. Further, the resin material may have a monomeric form.

The photoinitiator is an additive acting on a polymeric crosslinkable group to promote crosslinking reaction. As the photoinitiator, for example, benzyl dimethyl ketal is added.

The solvent adjusts the viscosity of the resin material.

The first and second irradiation units 91 and 92 irradiate the UV ink discharged onto the recording medium P with ultraviolet rays. The first irradiation unit 91 is provided on one side (the + side in the X-axis direction) of the head 8 along the first direction (X-axis direction), and the second irradiation unit 92 is provided on the other side (the − side in the X-axis direction). The first and second irradiation units 91 and 92 each include a light source 93 configured to irradiate the recording medium P with an ultraviolet ray curing the UV ink. As the light source 93, various types of light sources such as a Light Emitting Diode (LED), a Laser Diode (LD), a mercury lamp, a metal halide lamp, a Xenon lamp, and an excimer lamp can be used. A length in the Y-axis direction of the light source 93 is set to cover the plurality of nozzles 81 provided along the Y-axis direction of the head 8.

The printing unit 6 includes a first opening 87 functioning as a supply port 17 coupled to the smoke supply unit 10 described below and configured to eject smoke. Furthermore, the printing unit 6 includes a second opening 88 functioning as a suction port 21 coupled to the smoke collection unit 20 described below and configured to suck the smoke. Lengths in the Y-axis direction of the first and second openings 87 and 88 are each substantially equal to a length in the Y-axis direction of the head 8.

The first opening 87 (supply port 17) is located between the first irradiation unit 91 as the ultraviolet irradiation unit and the head 8. In particular, the printing unit 6 is provided with a first partition wall 85 disposed to face a first side surface 83 (at the + side in the X-axis direction) of the head 8 facing the first irradiation unit 91. In other words, the first partition wall 85 is disposed to face the first side surface 83 of the head 8 between the first irradiation unit 91 and the head 8. Both ends of the first partition wall 85 are coupled to the first side surface 83, and the first opening 87 is formed between the first partition wall 85 and the first side surface 83. That is, the supply port 17 is located between the first side surface 83 and the first partition wall 85 in a plan view from a vertical direction (Z-axis direction). Note that lengths in the Y-axis direction of the first and second openings 87 and 88 may each be equal to or greater than a length of a nozzle column including the nozzles 81 aligned in the Y-axis direction.

The second opening 88 (suction port 21) is located between the second irradiation unit 92 as the ultraviolet irradiation unit and the head 8. In particular, the printing unit 6 is provided with a second partition wall 86 disposed to face a second side surface 84 facing the first side surface 83 of the head 8. In other words, the second partition wall 86 is disposed to face the second side surface 84 of the head 8 between the second irradiation unit 92 and the head 8. Both ends of the second partition wall 86 are coupled to the second side surface 84, and the second opening 88 is formed between the second partition wall 86 and the second side surface 84. That is, the suction port 21 is located between the second side surface 84 and the second partition wall 86 in a plan view from the vertical direction (Z-axis direction).

Figure 7:
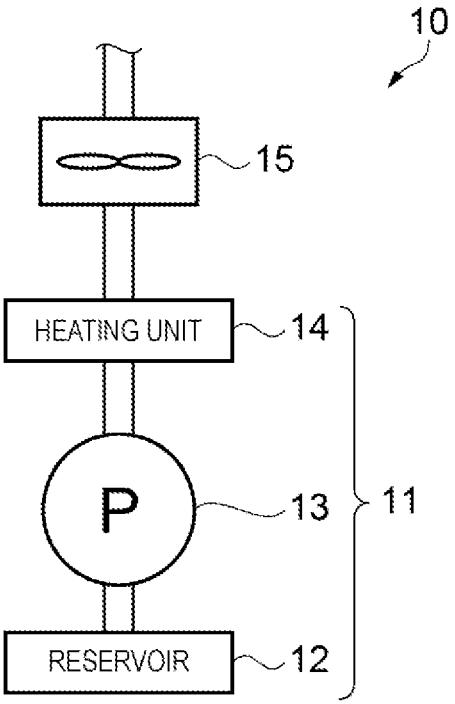
FIG. 7 is a view illustrating a configuration of a smoke supply unit.
Figure 8:
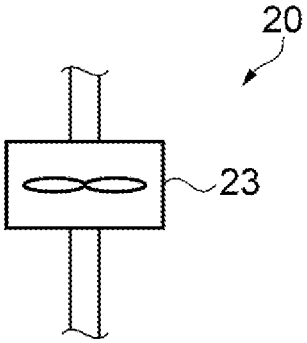
FIG. 8 is a view illustrating a configuration of a smoke collection unit.

FIG. 7 is a view illustrating a configuration of the smoke supply unit. FIG. 8 is a view illustrating a configuration of the smoke collection unit. Next, configurations of the smoke supply unit 10 and the smoke collection unit 20 will be described with reference to FIG. 5, FIG. 7, and FIG. 8. Note that hereinafter, a positional relationship along a movement direction of smoke fuel or smoke may also be referred to as "upstream" and "downstream".

As illustrated in FIG. 5, the smoke supply unit 10 is held by the carriage 61 configured to hold the head 8. Accordingly, the smoke supply unit 10 can move together with the head 8.

As illustrated in FIG. 7, the smoke supply unit 10 includes a smoke generation unit 11 configured to generate smoke and a fan 15 configured to blow the smoke. Accordingly, the smoke generated by the smoke generation unit 11 can be supplied efficiently. Further, the smoke generation unit 11 includes a reservoir 12 configured to store smoke fuel, a heating unit 14 configured to heat the smoke fuel to generate the smoke, and a pump 13 configured to supply the smoke fuel from the reservoir 12 to the heating unit 14. As the smoke fuel, for example, a liquid including kerosene as a main component, a liquid including glycol as a main component, and the like can be adopted.

The heating unit 14 can include, for example, wire made of nichrome (including 80% nickel and 20% chrome) and wound around a stainless tube. The smoke fuel fed by the pump 13 from the reservoir 12 located upstream to the heating unit 14 is heated by the heating unit 14, and accordingly, the smoke is generated. The fan 15 is located downstream of the heating unit 14, and blows the generated smoke downstream from the heating unit 14. Note that the reservoir 12 may include a removable cartridge configured to house the smoke fuel.

The smoke supply unit 10 is coupled to the supply port 17 configured to eject the smoke. In particular, the upstream of the fan 15 is coupled to the heating unit 14 and the downstream of the fan 15 is coupled to the first opening 87, and thus, the smoke generated by the smoke supply unit 10 is ejected through the first opening 87 (supply port 17). Accordingly, the smoke can be supplied suitably in a vicinity of the nozzle surface 82.

As illustrated in FIG. 8, the printing unit 6 includes the smoke collection unit 20 configured to collect the smoke. The smoke collection unit 20 is held by the carriage 61 configured to hold the head 8, and includes a fan 23 configured to suck and discharge the smoke. The smoke collection unit 20 is coupled to the suction port 21 configured to suck the smoke. In particular, the upstream of the fan 23 is coupled to the second opening 88 and the downstream of the fan 23 is opened to atmosphere. Accordingly, the smoke is sucked (collected) through the second opening 88 (suction port 21), and the collected smoke is released via the fan 23 to outside the printing apparatus 1. Note that the downstream of the fan 23 may be coupled to an exhaust facility of a factory where the printing apparatus 1 is installed.

With reference to FIG. 5 and FIG. 6 again, a region covered with the smoke will be described. Note that in FIG. 5 and FIG. 6, the movement direction of the smoke is indicated with an outlined arrow.

According to the printing unit 6 configured as above, the smoke supply unit 10 can supply the smoke to a part of an advancing path from the first and second irradiation units 91 and 92 as the ultraviolet irradiation unit to the nozzle surface 82 of ultraviolet rays entering the nozzle surface 82 and irradiated from the first and second irradiation units 91 and 92 to the nozzle surface 82. In particular, the ultraviolet rays irradiated from the first and second irradiation units 91 and 92 are reflected by the support stage 3 and the recording medium P, and are further repeatedly reflected and scattered by a member around the head 8 to reach the nozzle surface 82 from a gap between the head 8 and the recording medium P. A slight amount of the ultraviolet rays reaching the nozzle surface 82 is accumulated, and ink mist deposited on the nozzle surface 82 and the ink within the nozzle 81 may cure over time to cause a discharge defect (referred to as "nozzle omission" below) of the nozzle 81.

On the other hand, the smoke generated by the smoke supply unit 10 is ejected through the supply port 17 located between the first irradiation unit 91 and the head 8. The ejected smoke moves toward the suction port 21 located on the – side in the X-axis direction to block the gap between the nozzle surface 82 and the recording medium P. Furthermore, lengths in the Y-axis direction of the supply port 17 and the suction port 21 are each substantially equal to a length of the nozzle surface 82 (head 8), and thus, the nozzle surface 82 is entirely covered with the smoke. Accordingly, the gap between the head 8 and the recording medium P serving as the advancing path of the ultraviolet ray is blocked by a curtain of the smoke. The ultraviolet ray entering the nozzle surface 82 is shielded by this curtain of the smoke and thus, failures in ink discharge due to nozzle omission and the like are suppressed.

The smoke supply unit 10 supplies the smoke to a region other than a region between each of the first and second irradiation units 91 and 92 as the ultraviolet irradiation unit and the recording medium P in the advancing path. According to the configuration of the printing unit 6 described in the exemplary embodiment, the smoke ejected through the supply port 17 is sucked through the suction port 21, and thus, the smoke is not supplied to the region between each of the first and second irradiation units 91 and 92 and the recording medium P. Accordingly, the ultraviolet ray entering the nozzle surface 82 can be shielded without impeding curing of the UV ink discharged onto the recording medium P.

FIG. 9 is an electric block diagram illustrating an electrical configuration of the printing apparatus. Next, an electrical configuration of the printing apparatus 1 will be described with reference to FIG. 9.

The control unit 101 is configured to include an interface unit (I/F) 102, a Central Processing Unit (CPU) 103, a storage unit 104, a control circuit 105, and the like. The interface unit 102 is used for transmission and reception of data between the operation panel 35 (input device) configured to handle an input signal and an image and the control unit 101. The CPU 103 is an operation processing device configured to perform processing of an input signal from various types of detector groups 107 and control of a printing operation of the printing apparatus 1.

The storage unit 104 is a storage medium configured to ensure a region for storing a program of the CPU 103, a working region, and the like, and includes a storage element such as a Random Access Memory (RAM), and an Electrically Erasable Programmable Read Only Memory (EEPROM).

The control unit 101 controls drive of a nozzle actuator of the nozzle 81 provided in the head by a control signal output from the control circuit 105 to discharge the UV ink toward the recording medium P. The control unit 101 controls drive of the main scanning motor 77 provided in the main scanning drive mechanism 73 by a control signal output from the control circuit 105 to reciprocate the printing unit 6 in the main scanning direction (X-axis direction). The control unit 101 controls drive of the sub scanning motor 47 provided in the sub scanning drive mechanism 43 by a control signal output from the control circuit 105 to reciprocate the printing processing unit 5 in the sub scanning direction (Y-axis direction).

The control unit 101 controls a voltage of the light source 93 provided in each of the first and second irradiation units 91 and 92 by a control signal output from the control circuit 105 to turn on or turn off the light source 93. The control unit 101 control a voltage of the pump 13 and a current of the heating unit 14 provided in the smoke supply unit 10 by a control signal output from the control circuit 105 to generate the smoke, and controls a voltage of the fan 15 to generate a current of air to blow the generated smoke. The control unit 101 controls a voltage of the fan 23 provided in the smoke collection unit 20 by a control signal output from the control circuit 105 to generate a current of air to suck the smoke. An amount of the smoke between the nozzle surface 82 and the recording medium P can be controlled by controlling the smoke supply unit 10 and the smoke collection unit 20. Furthermore, the control unit 101 controls various devices not illustrated.

The control unit 101 controls the main scanning drive mechanism 73 and the head 8 to alternately repeat the main scanning of moving the printing unit 6 in the main scanning direction while discharging the UV ink from the head 8 and the sub scanning of controlling the sub scanning drive mechanism 43 to transport the printing processing unit 5 in the sub scanning direction. Accordingly, an image and the like are formed on the recording medium P.

Figure 10:
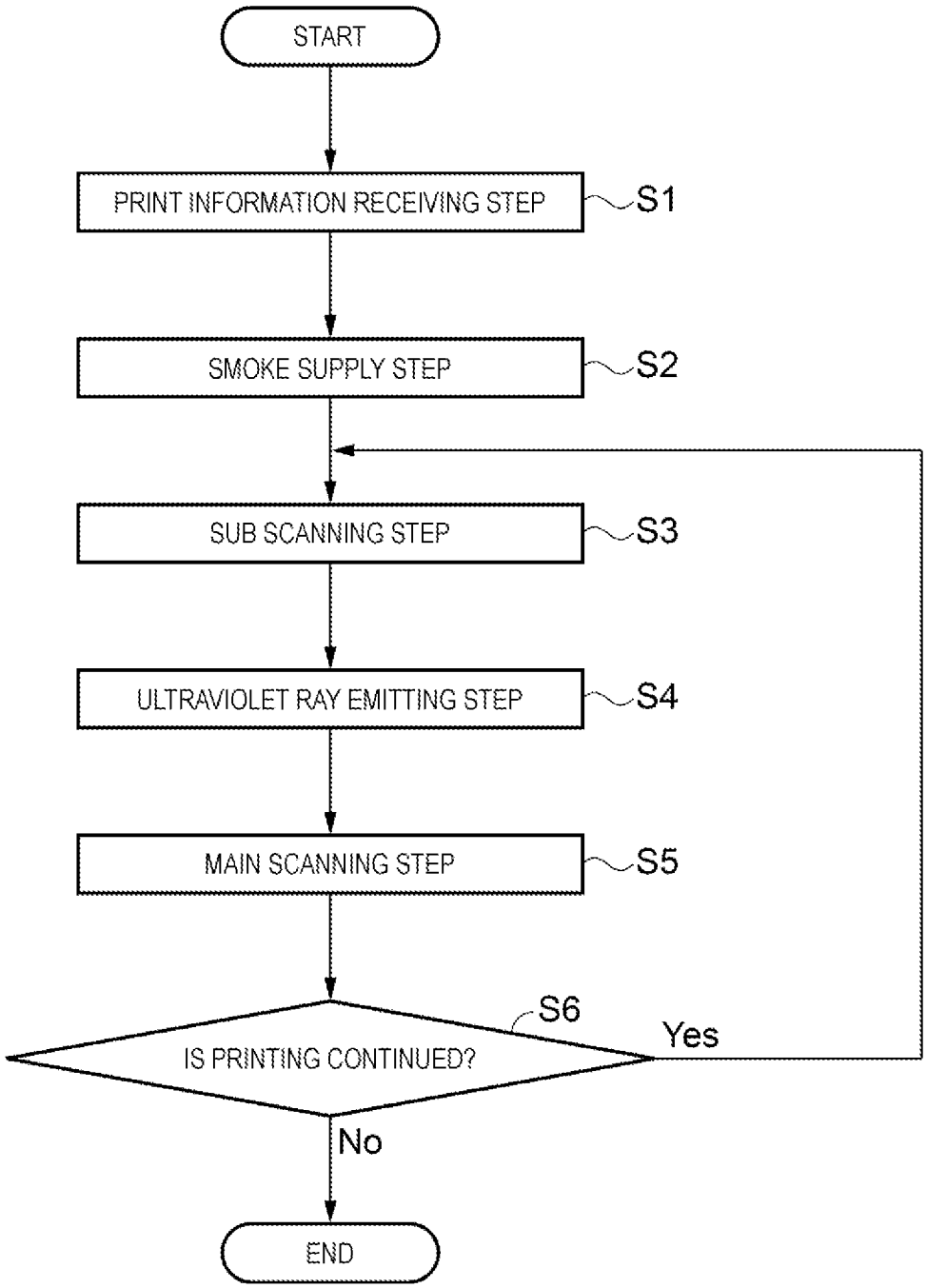
FIG. 10 is a flowchart illustrating a printing method of the printing apparatus.

FIG. 10 is a flowchart illustrating a printing method of the printing apparatus. Next, a printing method of the printing apparatus 1 will be described with reference to FIG. 10.

Step S1 is a print information receiving step of receiving print data. The control unit 101 receives an input of the print data based on an image selected via the operation panel 35 and print information such as a type of a recording medium, and stores the input into the storage unit 104.

Step S2 is a smoke supply step of supplying the smoke from the smoke supply unit 10. The control unit 101 drives the smoke supply unit 10 to eject the smoke through the supply port 17 located between the first irradiation unit 91 and the head 8. Furthermore, the control unit 101 drives the smoke collection unit 20 to suck the smoke through the suction port 21 located between the second irradiation unit 92 and the head 8. Accordingly, in the gap between the nozzle surface 82 and the recording medium P, a current of air from the supply port 17 toward the suction port 21 is generated, and the nozzle surface 82 is covered with the smoke.

Step S3 is a sub scanning step of moving the printing processing unit 5 in the sub scanning direction. The control unit 101 drives the sub scanning drive mechanism 43 to move, based on the print data, the printing processing unit 5 to a predetermined position in the sub scanning direction (Y-axis direction).

Step S4 is an ultraviolet ray emitting step of emitting the ultraviolet rays from the first and second irradiation units 91 and 92. The control unit 101 turns on the light source 93 of the first irradiation unit 91 or the second irradiation unit 92 located downstream in the scanning direction in the next main scanning, and turns off the light source 93 of the first irradiation unit 91 or the second irradiation unit 92 located upstream. Note that, for simplicity, the sub scanning step of step S3 and the ultraviolet ray emitting step of step S4 are described above as different steps; however, step S3 and step S4 may be replaced with each other, or may be performed substantially simultaneously.

Step S5 is a main scanning step of discharging the UV ink from the nozzle 81 of the head 8. The control unit 101 drives the main scanning drive mechanism 73 and also drives the actuator of the head 8 to discharge the UV ink from the nozzle 81 toward the recording medium P while moving the printing unit 6 in the main scanning direction (X-axis direction). At this time, the ultraviolet ray irradiated from the first irradiation unit 91 or the second irradiation unit 92 cures the UV ink. Furthermore, the nozzle surface 82 is covered with the smoke, and thus, the ultraviolet ray advancing toward the nozzle surface 82 is shielded. Accordingly, failures in ink discharge due to nozzle omission and the like are suppressed.

Step S6 is a determination step of determining whether to continue printing. The control unit 101 refers to the print data stored in the storage unit 104 to confirm whether there is print data in the next line. When there is the print data in the next line (step S6: Yes), the process returns to step S3 to repeat the process from step S3 to step S6. Accordingly, the main scanning and the sub scanning are repeated and an image and the like are printed on the recording medium P. When there is no print data in the next line (step S6: No), the control unit 101 ends the printing operation of the printing apparatus 1.

Note that in the exemplary embodiment, the flat bed type printing apparatus is described as an example and includes the configuration where the recording medium P is supported (fixed) on the support stage 3 and the head 8 is moved relative to the recording medium P fixed on the support stage 3 to perform printing; however, a printing apparatus may include a configuration where the recording medium P is supported to be transported by a movable support tray or a configuration where the recording medium P is transported by a pair of rollers and the like.

As described above, the printing apparatus 1 according to exemplary embodiment 1 can provide the following advantages.

The printing apparatus 1 includes the smoke supply unit 10 configured to supply the smoke. The smoke supply unit 10 supplies the smoke to the gap between the head 8 (nozzle surface 82) and the recording medium P serving as the advancing path of the ultraviolet ray entering the nozzle surface 82. The ultraviolet ray entering the nozzle surface 82 is shielded by this smoke and thus, failures in ink discharge due to nozzle omission and the like are suppressed. Accordingly, the printing apparatus 1 having improved printing quality can be provided.

The smoke supply unit 10 supplies no smoke to the region between each of the first and second irradiation units 91 and 92 and the recording medium P, and thus, the ultraviolet ray entering the nozzle surface 82 can be shielded without impeding curing of the UV ink discharged onto the recording medium P.

The smoke supply unit 10 includes the fan 15 configured to blow the smoke, and thus, the smoke generated by the smoke generation unit 11 can be supplied efficiently.

The smoke supply unit 10 is coupled to the supply port 17 configured to eject the smoke. The supply port 17 is located between the first irradiation unit 91 and the head 8, and thus, the smoke can be supplied suitably in the vicinity of the nozzle surface 82.

The supply port 17 is located between the first side surface 83 and the first partition wall 85 of the head 8. The smoke collection unit 20 configured to collect the smoke is coupled to the suction port 21 configured to suck the smoke, and the suction port 21 is located between the second side surface 84 and the second partition wall 86 of the head. The smoke ejected through the supply port 17 passes through the nozzle surface 82 and is sucked through the suction port 21. Accordingly, the nozzle surface 82 is covered with the smoke and the smoke does not intrude to the region between each of the first and second irradiation units 91 and 92 and the recording medium P, and thus, the ultraviolet ray entering the nozzle surface 82 can be shielded without impeding curing of the UV ink discharged onto the recording medium P.

The smoke supply unit 10 is held by the carriage 61 configured to hold the head 8. Accordingly, the smoke supply unit 10 can move together with the head 8.

The printing method of the printing apparatus 1 includes the smoke supply step of supplying the smoke from the smoke supply unit 10. At the smoke supply step, the smoke is supplied to the gap between the head 8 (nozzle surface 82) and the recording medium P serving as the advancing path of the ultraviolet ray entering the nozzle surface 82. The ultraviolet ray entering the nozzle surface 82 is shielded by this smoke and thus, failures in ink discharge due to nozzle omission and the like are suppressed. Accordingly, the printing method of the printing apparatus 1 having improved printing quality can be provided.

Note that the invention is not limited to the above-described exemplary embodiment, and various modifications can be made to the above-described exemplary embodiment without departing from the spirit and gist of the invention. Modifications of Exemplary Embodiment 1 will be described below.

Modification 1

Figure 11:
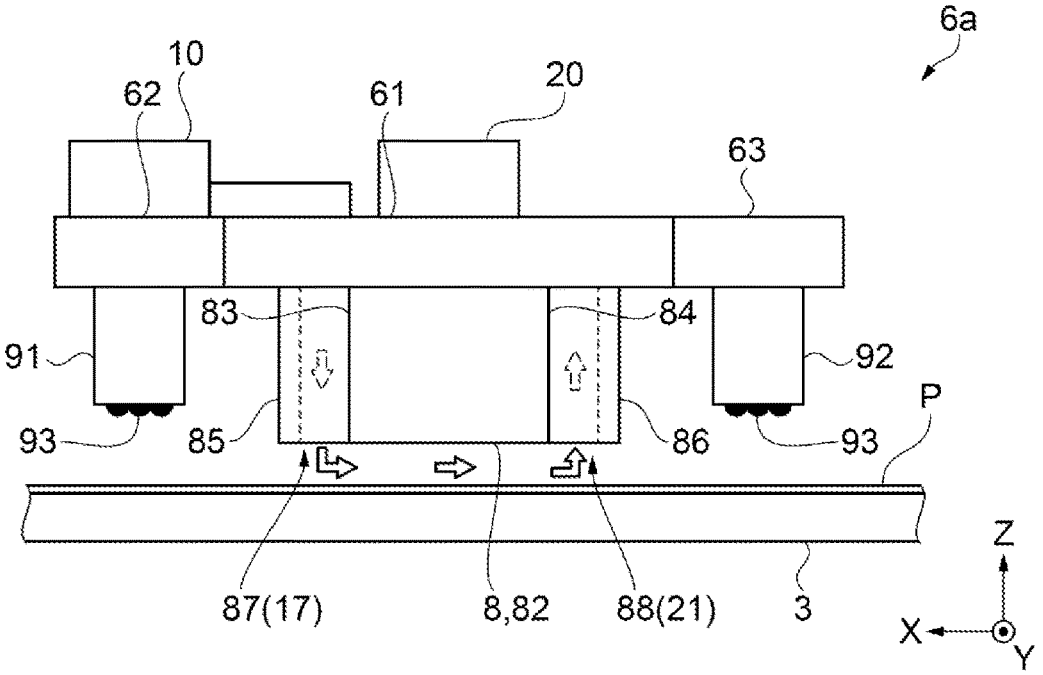
FIG. 11 is a side view illustrating a configuration of a printing unit according to Modification 1.

FIG. 11 is a side view illustrating a configuration of a printing unit according to Modification 1. Next, a configuration of a printing unit 6*a* according to Modification 1 will be described with reference to FIG. 11. Note that the same constituents as those in Exemplary Embodiment 1 are given the same reference signs, and redundant description of these constituents will be omitted.

As illustrated in FIG. 11, a smoke supply unit 10 may be held by a carriage 62 configured to hold a first irradiation unit 91. The smoke supply unit 10 is coupled to a supply port 17 located between the first irradiation unit 91 and a head 8, and smoke is ejected through the supply port 17. According to this configuration, the smoke supply unit 10 can move together with the first irradiation unit 91.

Modification 2

Figure 12:
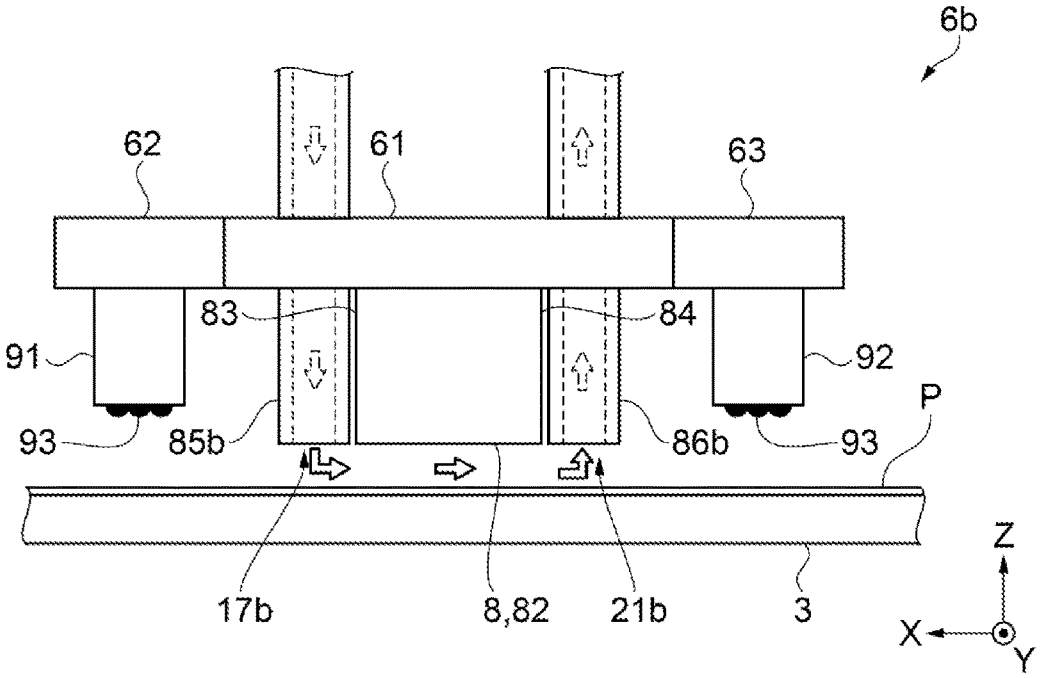
FIG. 12 is a side view illustrating a configuration of a printing unit according to Modification 2.

FIG. 12 is a side view illustrating a configuration of a printing unit according to Modification 2. Next, a configuration of a printing unit 6*b* according to Modification 2 will be described with reference to FIG. 12. Note that the same constituents as those in Exemplary Embodiment 1 are given the same reference signs, and redundant description of these constituents will be omitted.

The above-described smoke supply unit 10 is provided at a position isolated from a head 8 and first and second irradiation units 91 and 92. Smoke generated by the smoke supply unit 10 is supplied via a smoke supply tube 85*b*. The smoke supply tube 85*b* is located between the first irradiation unit 91 and the head 8, and an upper end of the smoke supply tube 85*b* (the + side in the Z-axis direction) is coupled to the smoke supply unit 10. Furthermore, a supply port 17*b* configured to eject smoke is formed at a lower end (the – side in the Z-axis direction) of the smoke supply tube 85*b*.

Furthermore, the above-described smoke collection unit 20 is provided at a position isolated from the head 8 and the first and second irradiation units 91 and 92. The smoke ejected through the supply port 17*b* is sucked via a smoke suction tube 86*b*. The smoke suction tube 86*b* is located between the head 8 and the second irradiation unit 92, and a suction port 21*b* configured to suck the smoke is formed at a lower end of the smoke suction tube 86*b* (the – side in the Z-axis direction). Furthermore, an upper end (the + side in the Z-axis direction) of the smoke suction tube 86*b* is coupled to the smoke collection unit 20. The smoke supply tube 85*b* and the smoke suction tube 86*b* are configured to be freely stretchable and freely flexible. According to this configuration, the smoke supply unit 10 and the smoke collection unit 20 can be installed at locations different from the location of the printing unit 6*b*. Accordingly, a degree of freedom of the installation locations of the smoke supply unit 10 and the smoke collection unit 20 can increase.

Modification 3

Figure 13:
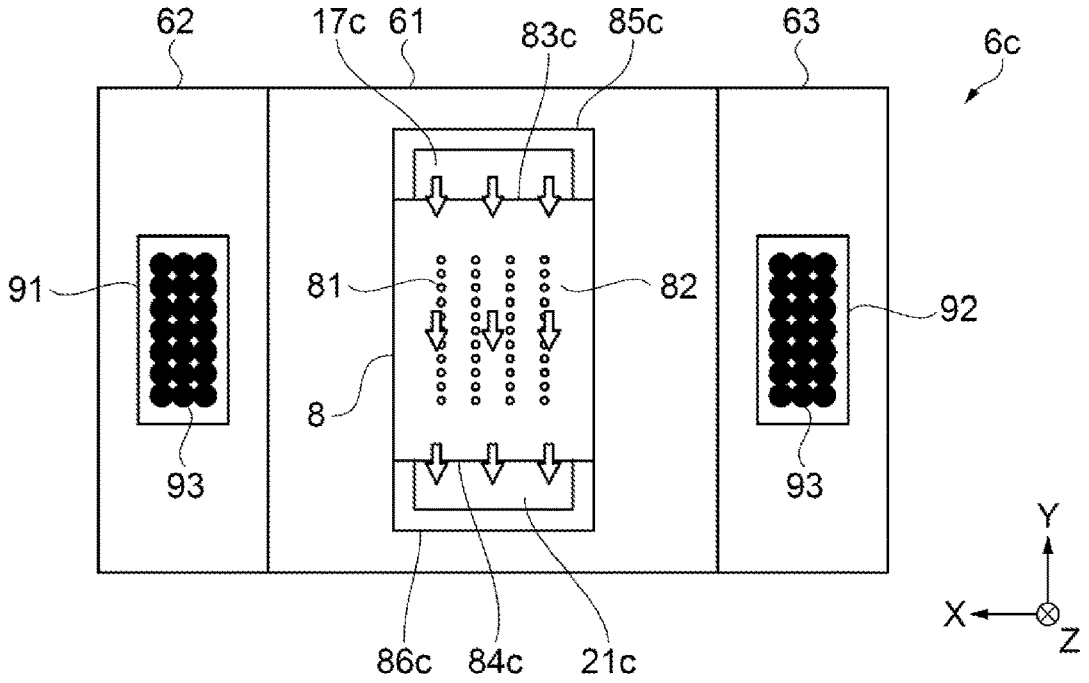
FIG. 13 is a plan view illustrating a configuration of a printing unit according to Modification 3.

FIG. 13 is a plan view illustrating a configuration of a printing unit according to Modification 3. Next, a configuration of a printing unit 6*c* according to Modification 3 will be described with reference to FIG. 13. Note that FIG. 13 illustrates a plan surface as viewed from the – side in the Z-axis direction. Furthermore, in FIG. 13, a movement direction of smoke is indicated with an outlined arrow. Furthermore, the same constituents as those in Exemplary Embodiment 1 are given the same reference signs, and redundant description of these constituents will be omitted.

The printing unit 6*c* is provided with a first partition wall 85*c* disposed to face a third side surface 83*c* corresponding to the + side in the Y-axis direction of a head 8. Both ends of the first partition wall 85*c* are coupled to the third side surface 83*c*, and a supply port 17*c* is formed between the first partition wall 85*c* and the third side surface 83*c*. A length in the X-axis direction of the supply port 17*c* is substantially equal to a length in the X-axis direction of the head 8. The supply port 17*c* is coupled to a smoke supply unit 10, and smoke generated by the smoke supply unit 10 is ejected through the supply port 17*c*.

The printing unit 6*c* is provided with a second partition wall 86*c* disposed to face a fourth side surface 84*c* facing the third side surface 83*c* of the head 8. Both ends of the second partition wall 86*c* are coupled to the fourth side surface 84*c*, and a suction port 21*c* is formed between the second partition wall 86*c* and the fourth side surface 84*c*. A length in the X-axis direction of the suction port 21*c* is substantially equal to the length in the X-axis direction of the head 8. The suction port 21*c* is coupled to a smoke collection unit 20, and the smoke supplied through the supply port 17*c* is sucked through the suction port 21*c*.

The smoke generated by the smoke supply unit 10 is ejected through the supply port 17*c* and moves toward the suction port 21*c* located on the – side in the Y-axis direction to block a gap between a nozzle surface 82 and a recording medium P. Furthermore, lengths in the X-axis direction of the supply port 17*c* and the suction port 21*c* are each substantially equal to a length of the nozzle surface 82 (head 8), and thus, the nozzle surface 82 is entirely covered with the smoke. Accordingly, a gap between the head 8 and the recording medium P serving as an advancing path of an ultraviolet ray is blocked with a curtain of the smoke. The ultraviolet ray entering the nozzle surface 82 is shielded by this curtain of the smoke and thus, failures in ink discharge due to nozzle omission and the like are suppressed.

Exemplary Embodiment 2

Figure 14:
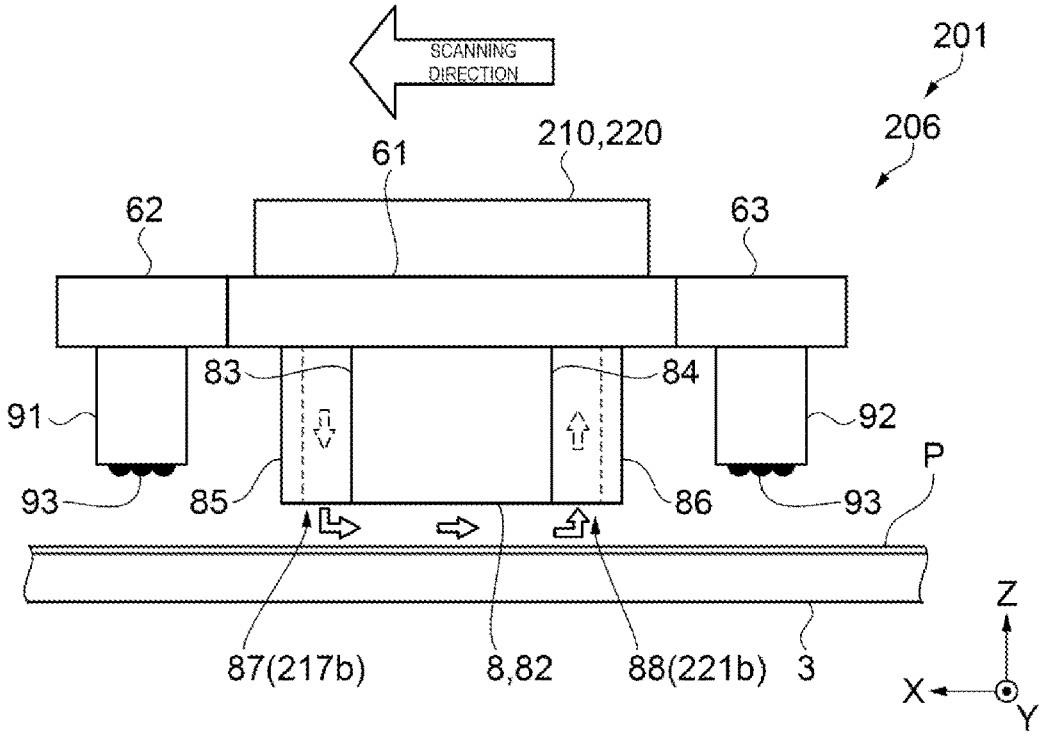
FIG. 14 is a side view illustrating a configuration of a printing unit according to Exemplary Embodiment 2.
Figure 15:
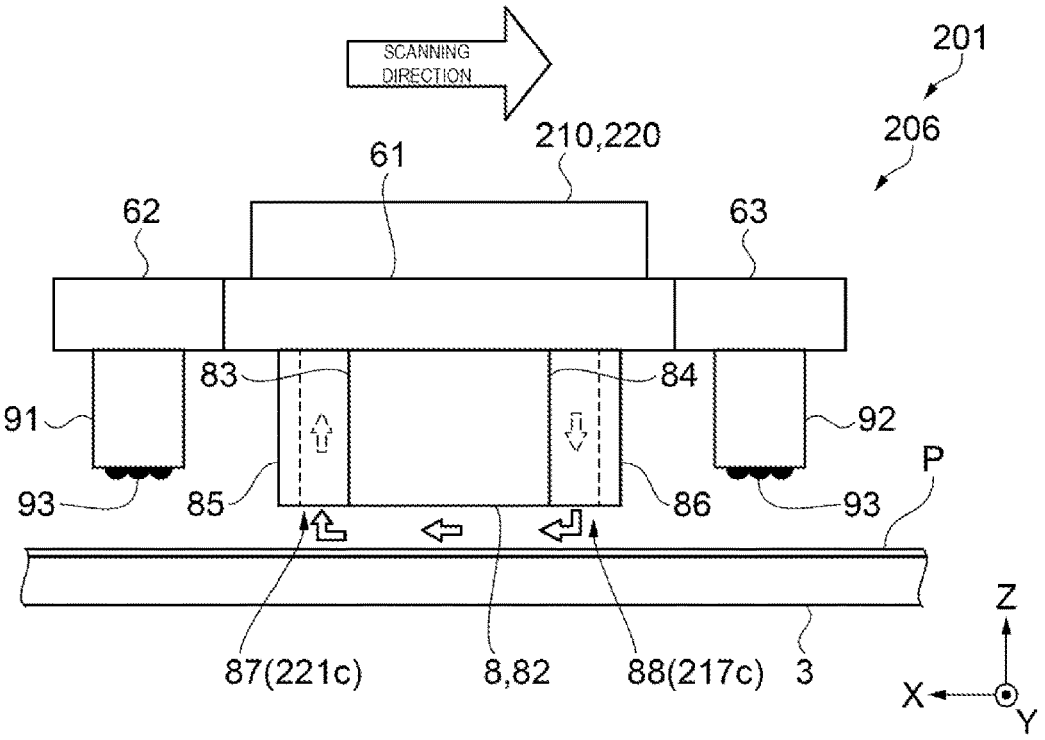
FIG. 15 is a side view illustrating a configuration of a printing unit.
Figure 16:
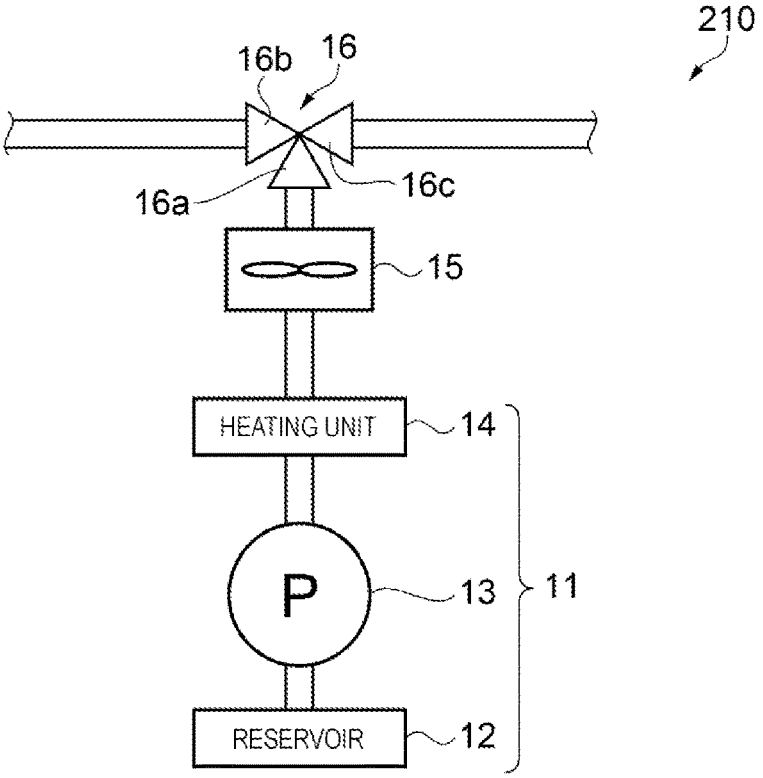
FIG. 16 is a view illustrating a configuration of a smoke supply unit.
Figure 17:
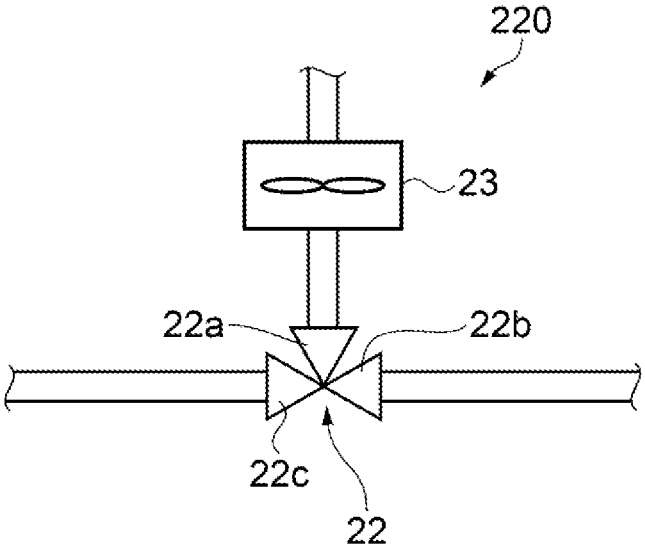
FIG. 17 is a view illustrating a configuration of a smoke collection unit.
Figure 18:
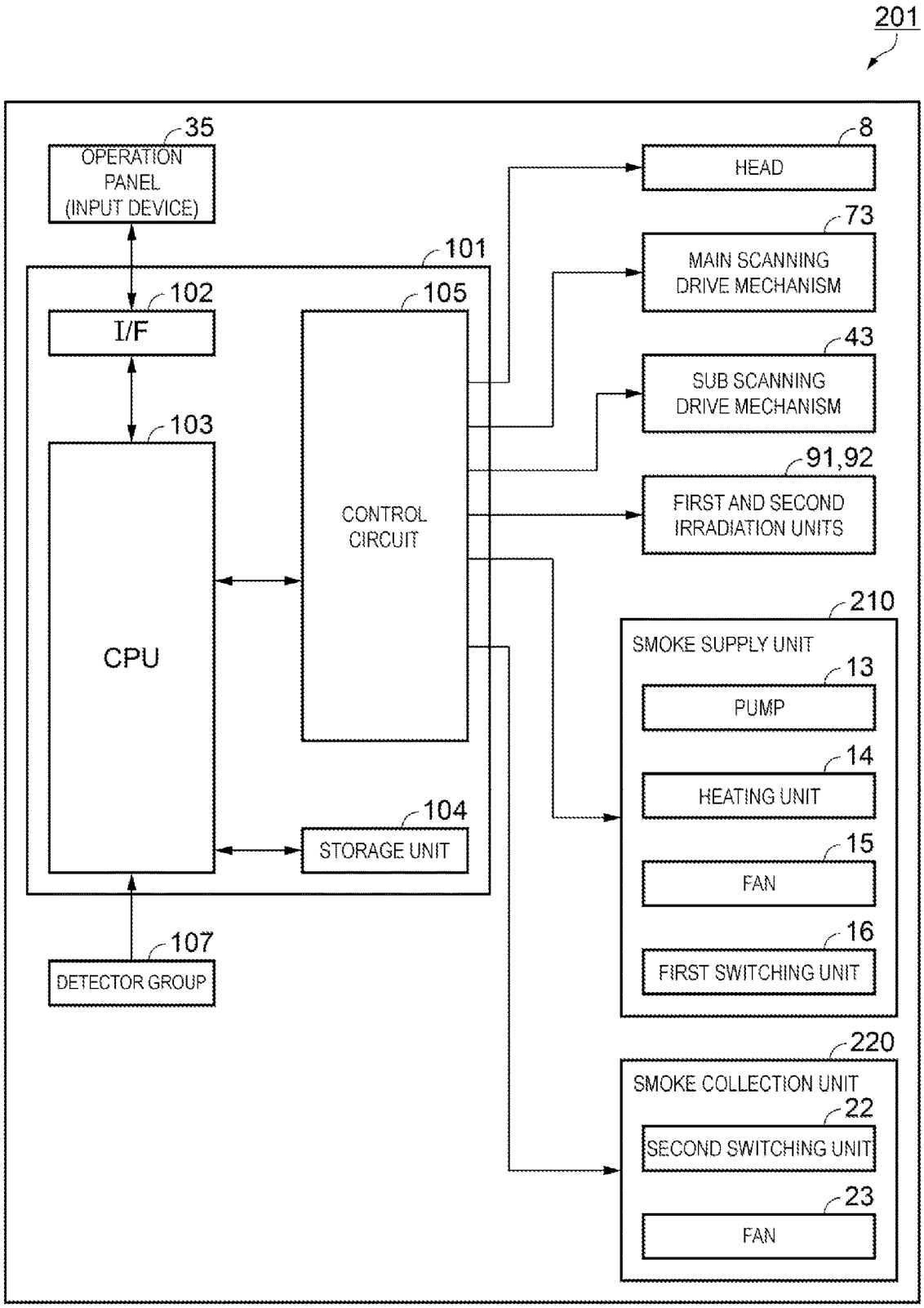
FIG. 18 is an electric block diagram illustrating an electrical configuration of a printing apparatus.

FIG. 14 and FIG. 15 are side views each illustrating a configuration of a printing unit according to Exemplary Embodiment 2. FIG. 16 is a view illustrating a configuration of a smoke supply unit. FIG. 17 is a view illustrating a configuration of a smoke collection unit. FIG. 18 is an electric block diagram illustrating an electrical configuration of a printing apparatus. Next, a configuration of a printing apparatus 201 according to Exemplary Embodiment 2 will be described with reference to FIG. 14 to FIG. 18. Note that in FIG. 14 and FIG. 15, a movement direction of a printing unit 206 and a movement direction of smoke are each indicated with an outlined arrow. Furthermore, the same constituents as those in Exemplary Embodiment 1 are given the same reference signs, and redundant description of these constituents will be omitted.

The printing apparatus 201 includes the printing unit 206, and the printing unit 206 includes a head 8, first and second irradiation units 91 and 92 as an ultraviolet irradiation unit, a smoke supply unit 210, and a smoke collection unit 220.

The printing unit 206 includes a first supply port 217*b* coupled to the smoke supply unit 210 described below and configured to eject smoke, or a first opening 87 coupled to the smoke collection unit 220 described below and functioning as a first suction port 221*c* configured to suck the smoke. The first opening 87 is located between a first side surface 83 and a first partition wall 85 in a plan view from the Z-axis direction.

The printing unit 206 includes a second supply port 217*c* coupled to the smoke supply unit 210 and configured to eject smoke, or a second opening 88 coupled to the smoke collection unit 220 and functioning as a second suction port 221*b* configured to suck the smoke. The second opening 88 is located between a second side surface 84 and a second partition wall 86 in a plan view from the Z-axis direction.

The smoke supply unit 210 is held by a carriage 61 configured to hold the head 8. As illustrated in FIG. 16, the smoke supply unit 210 includes a smoke generation unit 11, a fan 15, and a first switching unit 16. The first switching unit 16 is disposed downstream of the fan 15, and is configured to switch between supplying the smoke through the first opening 87 as the first supply port 217*b* and supplying the smoke through the second opening 88 as the second supply port 217*c*.

The first switching unit 16 of the exemplary embodiment is a so-called three-way electromagnetic valve, and includes valves 16*a*, 16*b*, and 16*c*. The valve 16*a* is coupled to the fan 15. The valve 16*b* is coupled to the first opening 87 (first supply port 217*b*). The valve 16*c* is coupled to the second opening 88 (second supply port 217*c*). The first switching unit 16 is controlled by a control unit 101 to perform a flow channel change between communicating the smoke generation unit 11 with the first opening 87 and communicating the smoke generation unit 11 with the second opening 88. The control unit 101 switches flow channels of the first switching unit 16 by a control signal output from a control circuit 105.

The smoke collection unit 220 is held by the carriage 61 configured to hold the head 8. As illustrated in FIG. 17, the smoke collection unit 220 includes a fan 23 and a second switching unit 22. The second switching unit 22 is disposed upstream of the fan 23, and is configured to switch between sucking the smoke through the first opening 87 as the first suction port 221*c* and sucking the smoke through the second opening 88 as the second suction port 221*b*.

The second switching unit 22 of the exemplary embodiment is a so-called three-way electromagnetic valve, and includes valves 22*a*, 22*b*, and 22*c*. The valve 22*a* is coupled to the fan 23. The valve 22*c* is coupled to the first opening 87 (first suction port 221*c*). The valve 22*b* is coupled to the second opening 88 (second suction port 221*b*). The second switching unit 22 is controlled by the control unit 101 to perform a flow channel change between communicating the first opening 87 with the fan 23 and communicating the second opening 88 with the fan 23. The control unit 101 switches flow channels of the second switching unit 22 by a control signal output from the control circuit 105.

Figure 19:
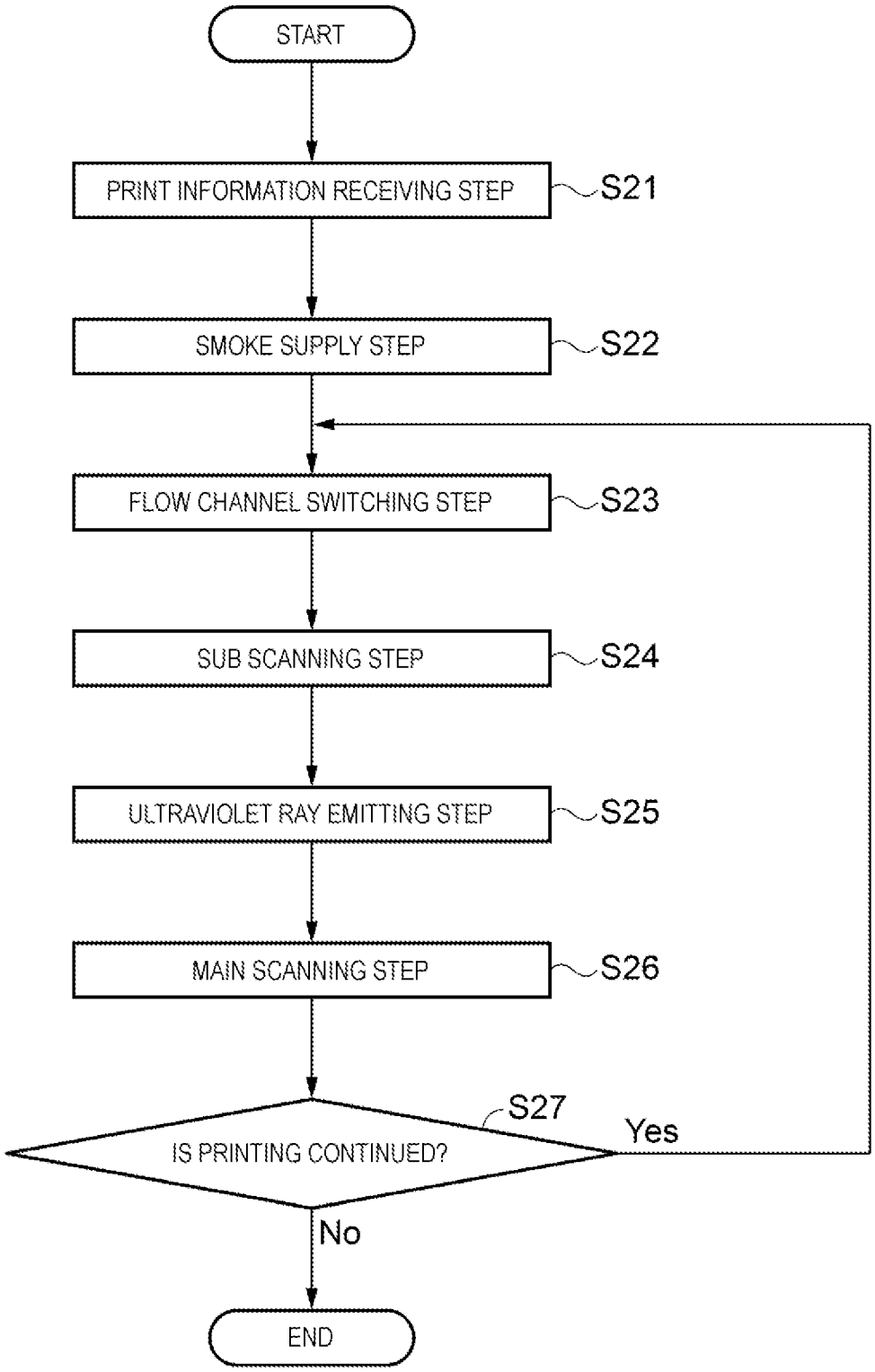
FIG. 19 is a flowchart illustrating a printing method of the printing apparatus.

FIG. 19 is a flowchart illustrating a printing method of the printing apparatus. Next, a printing method of the printing apparatus 201 will be described with reference to FIG. 14 to FIG. 19. Note that in the flowchart illustrated in FIG. 19, step S21 and step S22 are the same as step S1 and step S2 described in Exemplary Embodiment 1, and step S24 to step S26 are the same as step S3 to step S5, and thus, description of these steps will be omitted.

Step S23 is a flow channel switching step of switching flow channels of the smoke. The control unit 101 controls the first switching unit 16 and the second switching unit 22 according to a scanning direction in the next main scanning.

As illustrated in FIG. 14, when the printing unit 206 including the head 8 moves from the other side (the − side in the X-axis direction) in a first direction (X-axis direction) to one side (the + side in the X-axis direction) in the first direction, the control unit 101 controls the first switching unit 16 and the second switching unit 22 to cause the smoke to be supplied through the first opening 87 (first supply port 217*b*) and to be sucked through the second opening 88 (second suction port 221*b*). In particular, the control unit 101 switches the flow channels of the smoke by opening the valves 16*a* and 16*b* of the first switching unit 16 and closing the valve 16*c* to eject the smoke through the first opening 87. Furthermore, the control unit 101 switches the flow channels of the smoke by opening the valves 22*a* and 22*b* of the second switching unit 22 and closing the valve 22*c* to suck the smoke through the second opening 88.

A nozzle surface 82 of the head 8 is covered with a curtain of the smoke ejected through the first supply port 217*b* and to be sucked through the second suction port 221*b*. Accordingly, an ultraviolet ray irradiated from the second irradiation unit 92 located upstream in a movement direction of the head 8 and entering the nozzle surface 82 is shielded by this curtain of the smoke, and thus, failures in ink discharge due to nozzle omission and the like are suppressed. Furthermore, the smoke ejected through the first supply port 217*b* located downstream of the head 8 is suitably collected through the second suction port 221*b* located upstream of the head 8 moving downstream. Accordingly, the ultraviolet ray irradiated from the second irradiation unit 92 toward a recording medium P to cure UV ink is not impeded further upstream.

As illustrated in FIG. 15, when the printing unit 206 including the head 8 moves from the one side (the + side in the X-axis direction) to the other side (the − side in the X-axis direction) in the first direction (X-axis direction), the control unit 101 controls the first switching unit 16 and the second switching unit 22 to cause the smoke to be supplied through the second opening 88 (second supply port 217*c*) and to be sucked through the first opening 87 (first suction port 221*c*). In particular, the control unit 101 switches the flow channels of the smoke by opening the valves 16*a* and 16*c* of the first switching unit 16 and closing the valve 16*b* to eject the smoke through the second opening 88. Furthermore, the control unit 101 switches the flow channels of the smoke by opening the valves 22*a* and 22*c* of the second switching unit 22 and closing the valve 22*b* to suck the smoke through the first opening 87.

The nozzle surface 82 of the head 8 is covered with a curtain of the smoke ejected through the second supply port 217*c* and to be sucked through the first suction port 221*c*. Accordingly, an ultraviolet ray irradiated from the first irradiation unit 91 located upstream in the movement direction of the head 8 and entering the nozzle surface 82 is shielded by this curtain of the smoke, and thus, failures in ink discharge due to nozzle omission and the like are suppressed. Furthermore, the smoke ejected through the second supply port 217*c* located downstream of the head 8 is suitably collected through the first suction port 221*c* located upstream of the head 8 moving downstream. Accordingly, the ultraviolet ray irradiated from the first irradiation unit 91 toward the recording medium P to cure UV ink is not impeded further upstream.

Step S27 is a determination step of determining whether to continue printing. The control unit 101 refers to print data stored in a storage unit 104 to confirm whether there is print data in the next line. When there is the print data in the next line (step S27: Yes), the process returns to step S23 to repeat the process from step S23 to step S27. Accordingly, main scanning and sub scanning are repeated and an image and the like are printed on the recording medium P. When there is no print data in the next line (step S27: No), the control unit 101 ends a printing operation of the printing apparatus 201.

As described above, the printing apparatus 201 according to Exemplary Embodiment 2 can provide the following advantages.

When the head 8 moves from the other side to the one side, the control unit 101 controls the first and second switching units 16 and 22 to cause the smoke to be ejected through the first supply port 217*b* located downstream of the head 8 and to be sucked through the second suction port 221*b* located upstream of the head 8. Accordingly, the nozzle surface 82 of the head 8 is covered with the curtain of the smoke, and the ultraviolet ray entering the nozzle surface 82 is shielded. Failures in ink discharge due to nozzle omission and the like are suppressed. Furthermore, the smoke is suitably collected through the second suction port 221*b*, and thus, the ultraviolet ray irradiated from the second irradiation unit 92 toward the recording medium P to cure the UV ink is not impeded. Accordingly, the ultraviolet ray entering the nozzle surface 82 can be shielded without impeding curing of the UV ink. Therefore, the printing apparatus 201 having improved printing quality can be provided.

When the head 8 moves from the one side to the other side, the control unit 101 controls the first and second switching units 16 and 22 to cause the smoke to be ejected through the second supply port 217*c* located downstream of the head 8 and to be sucked through the first suction port 221*c* located upstream of the head 8. Accordingly, the nozzle surface 82 of the head 8 is covered with the curtain of the smoke, and the ultraviolet ray entering the nozzle surface 82 is shielded, and thus, failures in ink discharge due to nozzle omission and the like are suppressed. Furthermore, the smoke is suitably collected through the first suction port 221*c*, and thus, the ultraviolet ray irradiated from the first irradiation unit 91 toward the recording medium P to cure the UV ink is not impeded. Accordingly, the ultraviolet ray entering the nozzle surface 82 can be shielded without impeding curing of the UV ink. Therefore, the printing apparatus 201 having improved printing quality can be provided.

Exemplary Embodiment 3

Figure 20:
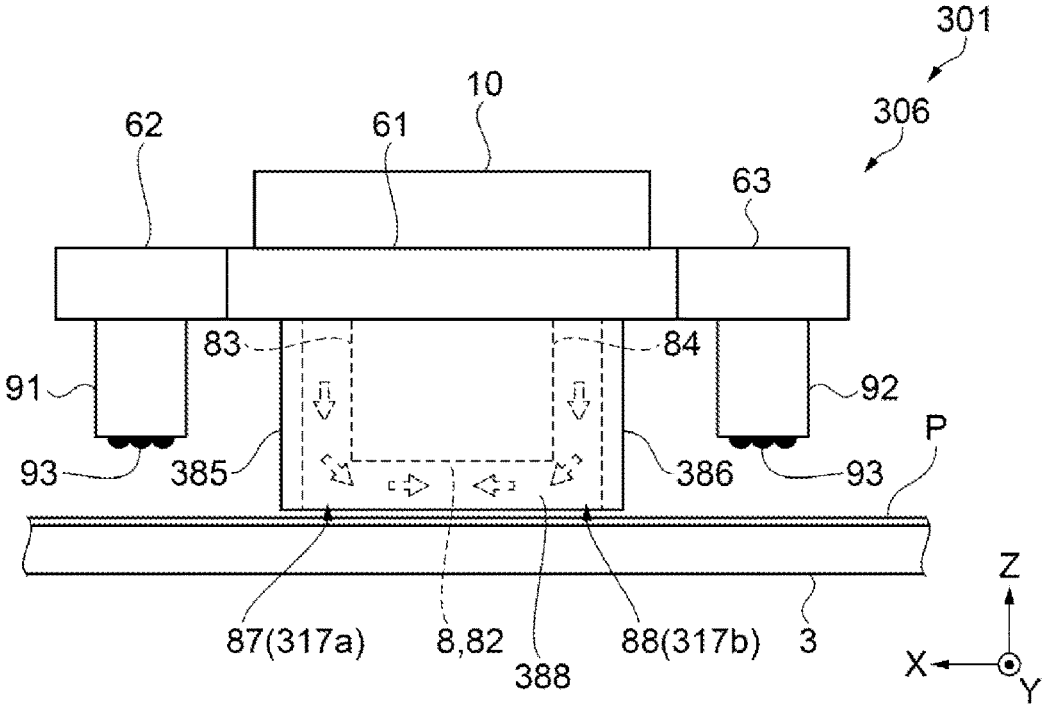
FIG. 20 a side view illustrating a configuration of a printing unit according to Exemplary Embodiment 3.
Figure 21:
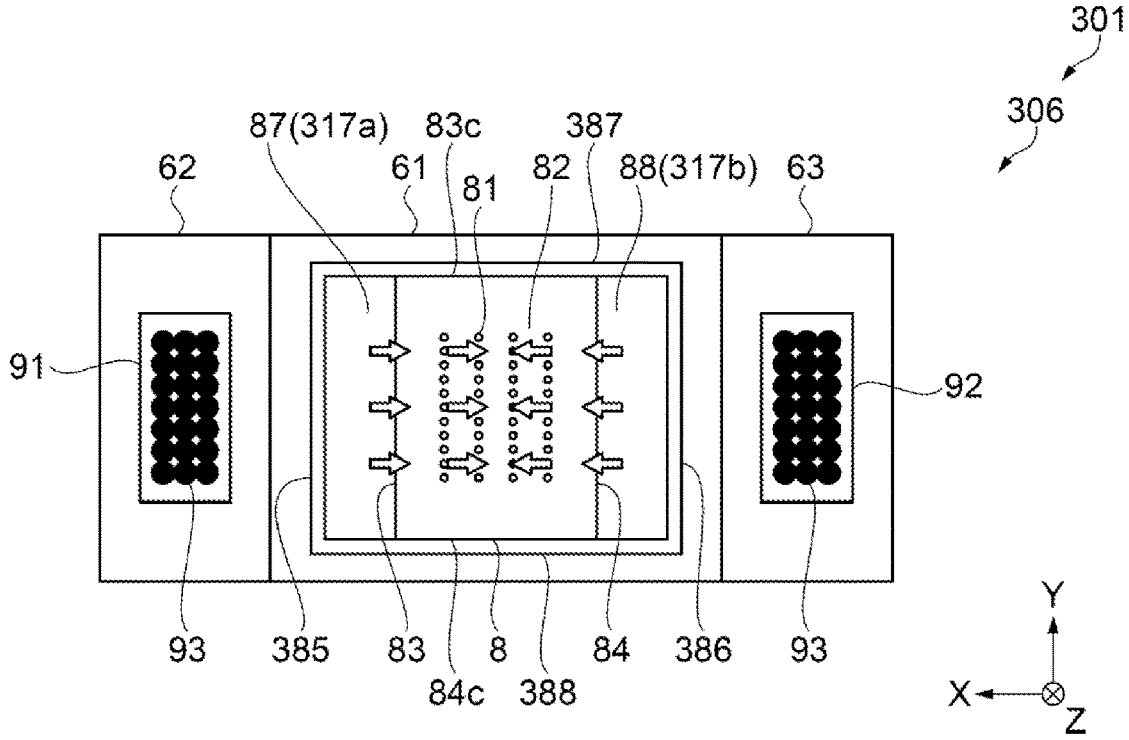
FIG. 21 is a plan view illustrating the configuration of the printing unit.

FIG. 20 is a side view illustrating a configuration of a printing unit according to Exemplary Embodiment 3. FIG. 21 is a plan view illustrating the configuration of the printing unit. Next, a printing apparatus 301 according to Exemplary Embodiment 3 will be described with reference to FIG. 20 and FIG. 21. Note that in FIG. 20 and FIG. 21, a movement direction of smoke is indicated with an outlined arrow. Furthermore, the same constituents as those in Exemplary Embodiment 1 are given the same reference signs, and redundant description of these constituents will be omitted.

The printing apparatus 301 includes a printing unit 306, and the printing unit 306 includes a head 8, first and second irradiation units 91 and 92 as an ultraviolet irradiation unit, and a smoke supply unit 10.

The printing unit 306 includes a first opening 87 functioning as a first supply port 317*a* and a second opening 88 functioning as a second supply port 317*b*, and the first opening 87 and the second opening 88 are coupled to the smoke supply unit 10 and configured to eject smoke.

The printing unit 306 includes a first partition wall 385 disposed to face a first side surface 83 of the head 8, a second partition wall 386 disposed to face a second side surface 84 of the head 8, a third partition wall 387 disposed to face a third side surface 83*c* of the head 8, and a fourth partition wall 388 disposed to face a fourth side surface 84*c* of the head 8. One end (the + side in the Y-axis direction) of the first partition wall 385 and one end (the + side in the Y-axis direction) of the second partition wall 386 are coupled to the third partition wall 387, and the other end (the − side in the Y-axis direction) of the first partition wall 385 and the other end (the − side in the Y-axis direction) of the second partition wall 386 are coupled to the fourth partition wall 388. Accordingly, the first opening 87 is formed between the first partition wall 385 and the first side surface 83, and the second opening 88 is formed between the second partition wall 386 and the second side surface 84.

The smoke supply unit 10 is coupled to the first opening 87 (first supply port 317*a*) configured to eject the smoke and the second opening 88 (second supply port 317*b*) configured to eject the smoke. In particular, the downstream of a fan 15 is divided into two parts to be coupled to the first opening 87 and the second opening 88. The smoke generated in a heating unit 14 is ejected through the first opening 87 (first supply port 317*a*) and the second opening 88 (second supply port 317*b*).

Furthermore, an interval between each of lower ends (the − side in the Z-axis direction) of the first and second partition walls 385 and 386 and the third and fourth walls 387 and 388, and a recording medium P is smaller than an interval between a nozzle surface 82 and the recording medium P. Accordingly, the smoke ejected through the first opening 87 (first supply port 317*a*) and the second opening 88 (second supply port 317*b*) is held in a space surrounded by the first and second partition walls 385 and 386 and the third and fourth walls 387 and 388, and a gap between the head 8 and the recording medium P serving as an advancing path of an ultraviolet ray is blocked by a curtain of the smoke. The ultraviolet ray entering the nozzle surface 82 is shielded by this curtain of the smoke and thus, failures in ink discharge due to nozzle omission and the like are suppressed. Therefore, the printing apparatus 301 having improved printing quality can be provided.

Note that the invention is not limited to the above-described exemplary embodiments, and various modifications can be made to the above-described exemplary embodiments without departing from the spirit and gist of the invention. A modification of Exemplary Embodiment 3 will be described below. Note that the same constituents as those in Exemplary Embodiment 3 are given the same reference signs, and redundant description of these constituents will be omitted.

Modification 4

Figure 22:
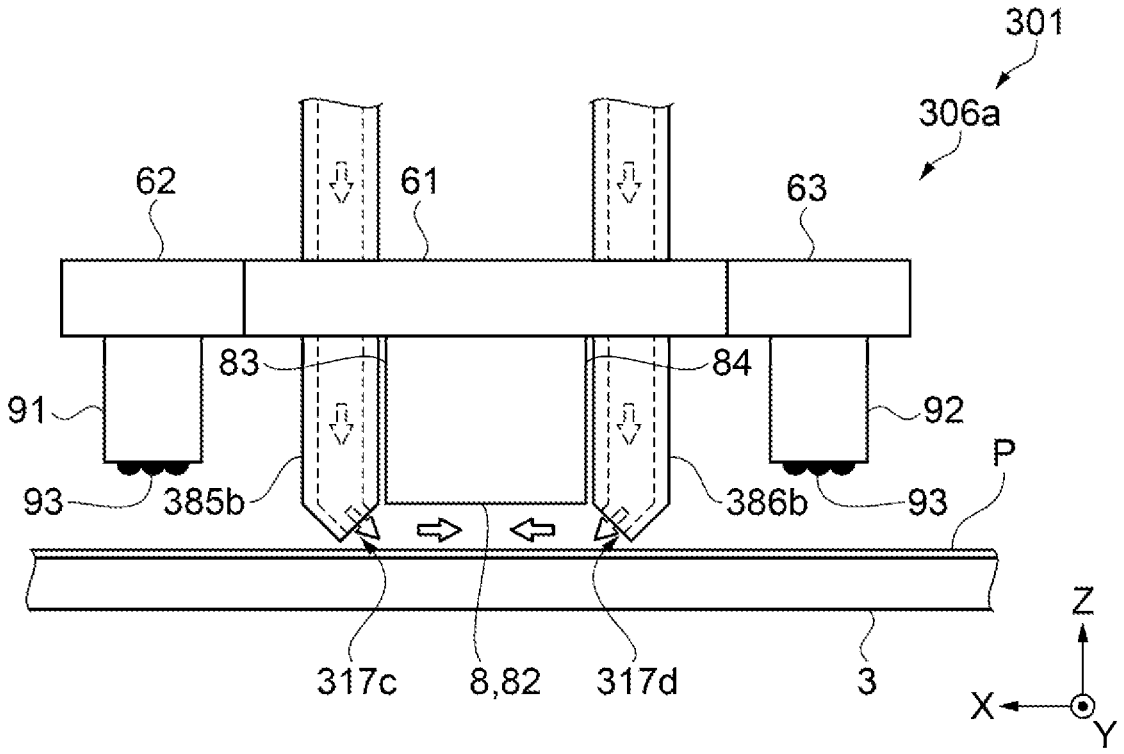
FIG. 22 is a side view illustrating a configuration of a printing unit according to Modification 4.

FIG. 22 is a side view illustrating a configuration of a printing unit according to Modification 4. Next, a printing unit 306*a* according to Modification 4 will be described with reference to FIG. 22.

The above-described smoke supply unit 10 is provided at a position isolated from a head 8 and first and second irradiation units 91 and 92. Smoke generated by the smoke supply unit 10 is supplied via smoke supply tubes 385*b* and 386*b*. Upper ends (the + side in the Z-axis direction) of the smoke supply tubes 385*b* and 386*b* are coupled to the smoke supply unit 10.

The smoke supply tube 385*b* is located between the first irradiation unit 91 and the head 8, and a first supply port 317*c* configured to eject smoke is formed at a lower end (the − side in the Z-axis direction) of the smoke supply tube 385*b*. The lower end of the smoke supply tube 385*b* is inclined toward the − side in the X-axis direction, and the first supply port 317*c* is opened to be inclined toward a nozzle surface 82. Furthermore, an interval between the lower end (the − side in the Z-axis direction) of the smoke supply tube 385*b* and a recording medium P is smaller than an interval between the nozzle surface 82 and the recording medium P. Accordingly, the smoke ejected through the first supply port 317*c* can easily move in a nozzle surface 82 direction.

The smoke supply tube 386*b* is located between the second irradiation unit 92 and the head 8, and a second supply port 317*b* configured to eject the smoke is formed at a lower end (the − side in the Z-axis direction) of the smoke supply tube 386*b*. The lower end of the smoke supply tube 386*b* is inclined toward the + side in the X-axis direction, and the second supply port 317*d* is opened to be inclined toward the nozzle surface 82. Furthermore, an interval between the lower end (the − side in the Z-axis direction) of the smoke supply tube 386*b* and the recording medium P is smaller than an interval between the nozzle surface 82 and the recording medium P. Accordingly, the smoke ejected through the second supply port 317*d* can easily move in the nozzle surface 82 direction.

The smoke is ejected toward the nozzle surface 82 through the first supply port 317*c* and the second supply port 317*d*, and accordingly, a gap between the head 8 and the recording medium P serving as an advancing path of an ultraviolet ray is blocked by a curtain of the smoke. The ultraviolet ray entering the nozzle surface 82 is shielded by this curtain of the smoke and thus, failures in ink discharge due to nozzle omission and the like are suppressed.

Exemplary Embodiment 4

Figure 23:
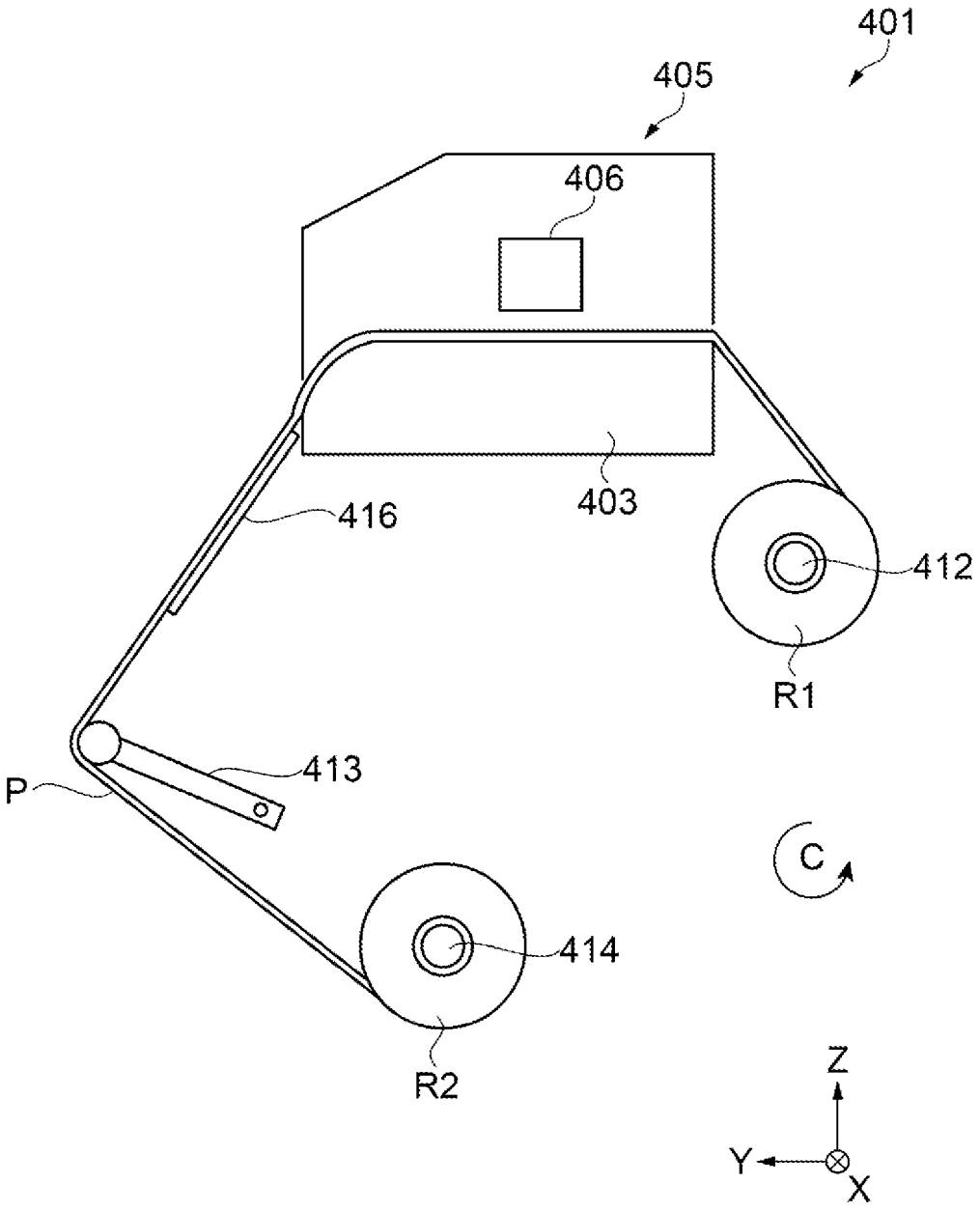
FIG. 23 is a side view illustrating a configuration of a printing apparatus according to Exemplary Embodiment 4.
Figure 24:
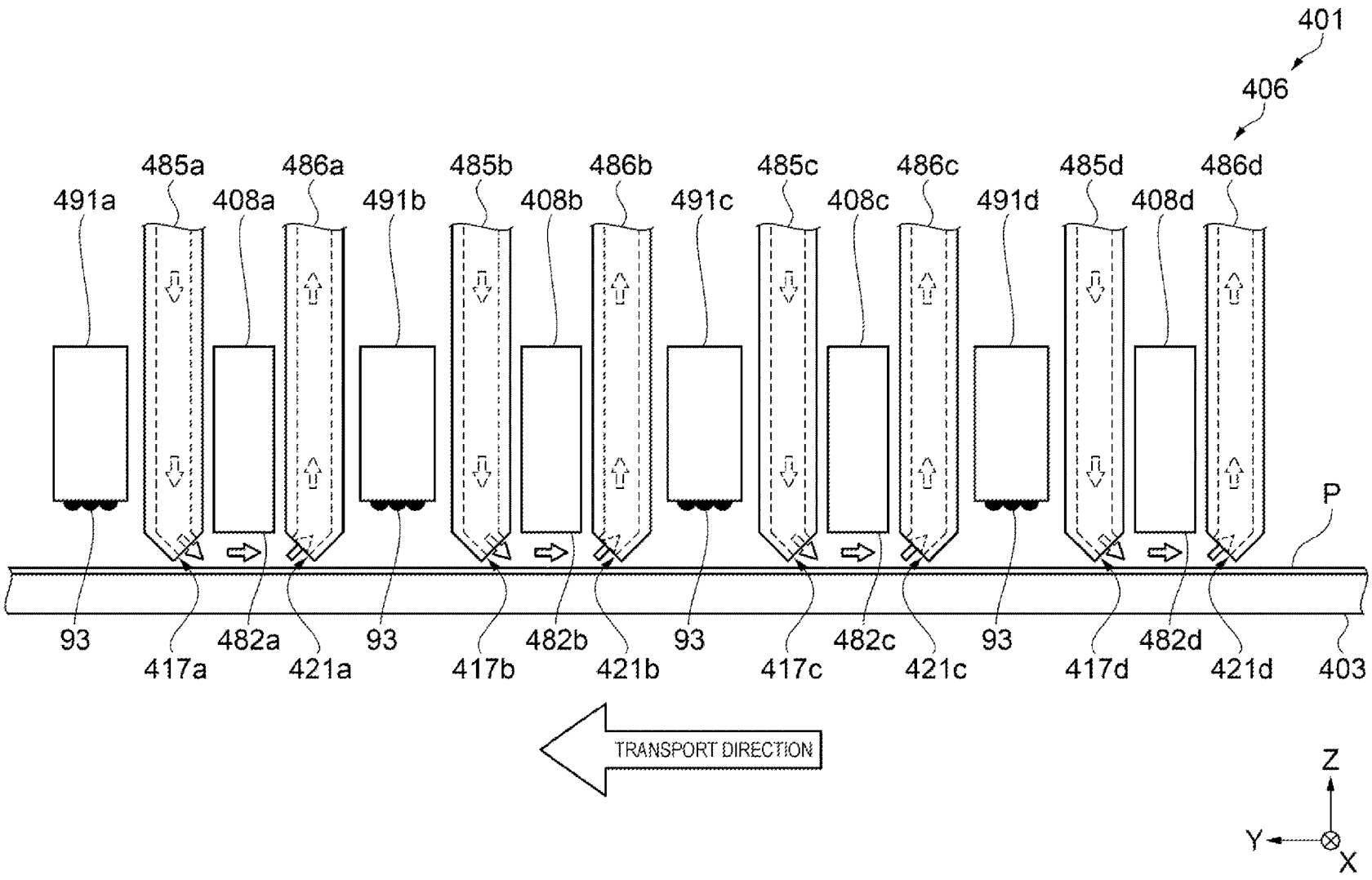
FIG. 24 is a side view illustrating a configuration of a printing unit.

FIG. 23 is a side view illustrating a schematic configuration of a printing apparatus according to Exemplary Embodiment 4. FIG. 24 is a side view illustrating a configuration of a printing unit. Next, a printing apparatus 401 according to Exemplary Embodiment 4 will be described with reference to FIG. 23 and FIG. 24. Note that the printing apparatus 401 described in the exemplary embodiment includes a roll-to-roll type large format printer (LFP) configured to handle a medium (recording medium) relatively large. In Exemplary Embodiment 1 to Exemplary Embodiment 3 described above, the printing apparatuses 1, 201, and 301 of a serial head type are described and each include the configuration where the head is mounted in the carriage 61 configured to reciprocate, and discharges the ink while moving in the width direction (the + side and the − side in the X-axis direction) of the recording medium P; however, the printing apparatus 401 described in the exemplary embodiment is of a line head type where heads extend in a width direction (X-axis direction) of a recording medium P and are fixedly aligned. Furthermore, in FIG. 24, a movement direction of smoke is indicated with an outlined arrow. Furthermore, the same constituents as those in Exemplary Embodiment 1 are given the same reference signs, and redundant description of these constituents will be omitted.

As illustrated in FIG. 23, the printing apparatus 401 includes a printing processing unit 405 configured to perform recording on the recording medium P, a platen 403 disposed at a position facing the printing processing unit 405 and configured to support the recording medium P, a medium feed unit 412 configured to feed the recording medium P of a roll type, as a transport mechanism configured to transport the recording medium P in a transport direction (the + Y-axis direction in the printing processing unit 405), and a medium winding unit 414 configured to wind the recording medium P in a roll form. Here, the recording medium of a roll type is used as the recording medium P; however, the invention is not limited to the printing apparatus using such a recording medium of a roll type. Note that hereinafter, a positional relationship along the transport direction of the recording medium P is also referred to as "upstream", and "downstream", and a medium feed unit 412 side corresponds to the upstream and a medium winding unit 414 side corresponds to the downstream.

The recording medium P of a roll type (roll R1) is set to the medium feed unit 412. The medium feed unit 412 is configured to be capable of feeding the recording medium P to the printing processing unit 405. The medium feed unit 412 rotates in a rotation direction C when the medium feed unit 412 transports the recording medium P in the transport direction. The transport mechanism includes a plurality of transport rollers (not illustrated) configured to transport the recording medium P in the transport direction. Furthermore, a medium support unit 416 as a transport path through which the recording medium P having subjected to recording is transported in the transport direction is provided downstream of the platen 403.

A tension adjustment unit 413 configured to adjust tension of the recording medium P when the recording medium P is wound up is provided downstream of the medium support unit 416. Then, a medium winding unit 414 configured to be capable of winding the recording medium P is provided downstream of the tension adjustment unit 413. The medium winding unit 414 rotates in the rotation direction C, and accordingly, the recording medium P is wound in a roll form to form a roll R2.

The printing processing unit 405 includes a printing unit 406. The printing unit 406 records an image and the like onto the recording medium P supported by the platen 403 and transported in the transport direction.

As illustrated in FIG. 24, the printing unit 406 includes heads 408*a*, 408*b*, 408*c*, and 408*d* configured to discharge UV ink onto the recording medium P, and ultraviolet irradiation units 491*a*, 491*b*, 491*c*, and 491*d* configured to irradiate the UV ink discharged from each of the heads 408*a*, 408*b*, 408*c*, and 408*d* onto the recording medium P with ultraviolet rays. Each of the heads 408*a*, 408*b*, 408*c*, and 408*d* is a so-called line head fixed to extend in the width direction (X-axis direction) of the recording medium P. The heads 408*a* to 408*d* are aligned in order of the heads 408*a*, 408*b*, 408*c*, and 408*d* from the downstream (the + side in the Y-axis direction) toward the upstream (the − side in the Y-axis direction) in the transporting direction of the recording medium P. The heads 408*a* to 408*d* are supplied with the UV ink via an ink supply tube (not illustrated) from an ink tank (not illustrated) provided at a location different from a location of the printing processing unit 405.

The printing unit 406 includes smoke supply tubes 485*a*, 485*b*, 485*c*, and 485*d*. Upper ends (the + side in the Z-axis direction) of the smoke supply tubes 485*a* to 485*d* are coupled to a smoke supply unit 10 provided at a position isolated from the printing unit 406. Furthermore, the printing unit 406 includes smoke suction tubes 486*a*, 486*b*, 486*c*, and 486*d*. Upper ends of the smoke suction tubes 486*a* to 486*d* are coupled to a smoke collection unit 20 provided at a position isolated from the printing unit 406.

The head 408*a* includes a nozzle surface 482*a* on which a plurality of nozzles 81 configured to discharge, for example, UV ink of yellow (Y) are formed. An ultraviolet irradiation unit 491*a* is provided downstream of the head 408*a* to cure the UV ink discharged from the head 408*a*. The smoke supply tube 485*a* is provided between the head 408*a* and the ultraviolet irradiation unit 491*a*. Furthermore, the smoke suction tube 486*a* is provided at a position facing the smoke supply tube 485*a* via the head 408*a*.

A supply port 417*a* configured to eject smoke is formed at a lower end (the − side in the Z-axis direction) of the smoke supply tube 485*b*. A suction port 421*a* configured to suck the smoke is formed at a lower end of the smoke suction tube 486*a*. An interval between each of the lower ends of the smoke supply tube 485*a* and the smoke suction tube 486*a* and the recording medium P is smaller than an interval between the nozzle surface 482*a* and the recording medium P, and the supply port 417*a* and the suction port 421*a* are opened to be inclined toward the nozzle surface 482*a*. Furthermore, lengths in the X-axis direction of the supply port 417*a* and the suction port 421*a* are each substantially equal to a length of the nozzle surface 482*a* (head 408*a*). Accordingly, the smoke ejected through the supply port 417*a* moves toward the suction port 421*a* to block a gap between the nozzle surface 482*a* and the recording medium P, and entirely covers the nozzle surface 482*a*. Furthermore, the smoke is suitably collected through the suction port 421*a*, and thus, curing by the ultraviolet irradiation unit 491*a* of the UV ink discharged from the head 408*a* onto the recording medium P is not impeded.

The head 408*b* includes a nozzle surface 482*b* on which a plurality of nozzles 81 configured to discharge, for example, UV ink of magenta (M) are formed. An ultraviolet irradiation unit 491*b* is provided downstream of the head 408*b*.

The head 408*c* includes a nozzle surface 482*c* on which a plurality of nozzles 81 configured to discharge, for example, UV ink of cyan (C) are formed. An ultraviolet irradiation unit 491*c* is provided downstream of the head 408*c*.

The head 408*d* includes a nozzle surface 482*d* on which a plurality of nozzles 81 configured to discharge, for example, UV ink of black (K) are formed. An ultraviolet irradiation unit 491*d* is provided downstream of the head 408*d*.

The heads 408*b*, 408*c*, and 408*d*, the ultraviolet irradiation units 491*b*, 491*c*, and 491*d*, the smoke supply tubes 485*b*, 485*c*, and 485*d*, and the smoke suction tubes 486*b*, 486*c*, and 486*d* are similar in a configuration, a positional relationship and the like to the head 408*a*, the ultraviolet irradiation unit 491*a*, the smoke supply tube 485*a*, and the smoke suction tube 486*a*, and thus, description thereof will be omitted.

The nozzle surfaces 482*a* to 482*d* of the heads 408*a* to 408*d* provided in the printing unit 406 are covered with the smoke ejected through the supply ports 417*a* to 417*d*. Accordingly, a gap between each of the heads 408*a* to 408*d* and the recording medium P serving as an advancing path of an ultraviolet ray is blocked with a curtain of the smoke. An ultraviolet ray entering each of the nozzle surfaces 482*a* to 482*d* is shielded by this curtain of the smoke, and thus, failures in ink discharge due to nozzle omission and the like are suppressed. Therefore, the printing apparatus 401 having improved printing quality can be provided. Furthermore, in the exemplary embodiment, the movement direction of the smoke is described as a direction from the downstream to the upstream in the transport direction of the recording medium P; however, the positional relationship between the smoke supply tube and the smoke suction tube may be reversed in the transport direction of the recording medium P, and the movement direction of the smoke may be the same as the transport direction of the recording medium P.

Note that in Exemplary Embodiment 1 to Exemplary Embodiment 4 and Modification 1 to Modification 4 described above, it is assumed that the smoke is ejected through the supply port and the gap between the head 8 (nozzle surface 82) and the recording medium P is blocked with the curtain of the smoke; however, instead of the smoke, a gas having a high oxygen concentration may be ejected. The oxygen concentration may be more than 21% and equal to or less than 60%. The nozzle surface 82 of the head 8 is covered with the gas having a high oxygen concentration, and thus, polymerization reaction of the UV ink by the ultraviolet ray is suppressed by an oxygen suppression effect on photo polymerization of the UV ink. That is, even when the ultraviolet ray reaches the nozzle surface 82, curing of ink mist (UV ink) deposited on the nozzle surface 82 is suppressed. Accordingly, failures in ink discharge due to nozzle omission and the like are suppressed.

Furthermore, in Exemplary Embodiment 1 to Exemplary Embodiment 4 and Modification 1 to Modification 4 described above, it is assumed that the smoke is ejected through the supply port and the gap between the head 8 (nozzle surface 82) and the recording medium P is blocked with the curtain of the smoke; however, instead of the smoke, a colored gas may be ejected. The gas may be a gas of yellow green containing chlorine (CL2). Yellow green is a complementary color of purple having a wavelength partially overlapping a wavelength of an ultraviolet ray. The nozzle surface 82 of the head 8 is covered with the gas of yellow green, and accordingly, the ultraviolet ray is absorbed into the gas of yellow green that is a complementary color of purple. Thus, polymerization reaction of the UV ink is suppressed. That is, even when the ultraviolet ray reaches the nozzle surface 82, curing of ink mist (UV ink) deposited on the nozzle surface 82 is suppressed. Accordingly, failures in ink discharge due to nozzle omission and the like are suppressed.

Furthermore, a printing apparatus having a configuration obtained by appropriately combining the configurations of the units of the printing apparatuses 1, 201, 301, and 401 described in Exemplary Embodiment 1 to Exemplary Embodiment 4 and Modification 1 to Modification 4 described above may be adopted.

This application claims priority under 35 U.S.C. § 119 to Japanese Patent Application No. 2017-196623, filed Oct. 10, 2017. The entire disclosure of Japanese Patent Application No. 2017-196623 is hereby incorporated herein by reference.

What is claimed is:

1. A printing apparatus comprising:

a head including a nozzle disposed on a nozzle surface and configured to discharge ultraviolet-curable ink onto a recording medium;

an ultraviolet irradiation unit configured to irradiate the ultraviolet-curable ink discharged onto the recording medium with an ultraviolet ray; and a smoke supply unit configured to supply smoke to a part of an advancing path, from the ultraviolet irradiation unit to the nozzle surface, of an ultraviolet ray irradiated from the ultraviolet irradiation unit and entering the nozzle surface.

2. The printing apparatus according to claim 1, wherein the smoke supply unit is configured to supply the smoke to a region on the advancing path other than a region between the ultraviolet irradiation unit and the recording medium.

3. The printing apparatus according to claim 1, wherein the smoke supply unit includes a smoke generation unit configured to generate the smoke and a fan configured to blow the smoke.

4. The printing apparatus according to claim 1, wherein the smoke supply unit is coupled to a supply port configured to eject the smoke, and the supply port is located between the ultraviolet irradiation unit and the head.

5. The printing apparatus according to claim 3, further comprising:

a first partition wall disposed to face a first side surface of the head facing the ultraviolet irradiation unit; a second partition wall disposed to face a second side surface facing the first side surface of the head; and a smoke collection unit configured to collect the smoke, wherein the smoke supply unit is coupled to a supply port configured to eject the smoke and the supply port is located between the first side surface and the first partition wall in a plan view, and the smoke collection unit is coupled to a suction port configured to suck the smoke and the suction port is located between the second side surface and the second partition wall in a plan view.

6. The printing apparatus according to claim 1, further comprising:

a first partition wall; a second partition wall; a smoke collection unit configured to collect the smoke; a first supply port and a second supply port coupled to the smoke supply unit and configured to eject the smoke; and a first suction port and a second suction port coupled to the smoke collection unit and configured to suck the smoke, wherein the ultraviolet irradiation unit includes a first irradiation unit provided on one side of the head in a first direction and a second irradiation unit provided on the other side of the head in the first direction, the head is configured to reciprocate in the first direction, the first partition wall is disposed between the first irradiation unit and the head to face a first side surface of the head, the second partition wall is disposed between the second irradiation unit and the head to face a second side surface of the head, the first supply port and the first suction port are located between the first side surface and the first partition wall in a plan view from a vertical direction, and the second supply port and the second suction port are located between the second side surface and the second partition wall in a plan view from the vertical direction.

7. The printing apparatus according to claim 6, further comprising:

a first switching unit configured to switch between supplying the smoke through the first supply port and supplying the smoke through the second supply port; a second switching unit configured to switch between sucking the smoke through the first suction port and sucking the smoke through the second suction port; and a control unit configured to control the first switching unit and the second switching unit, wherein the control unit is configured to control the first switching unit and the second switching unit to supply the smoke through the first supply port and suck the smoke through the second suction port, when the head moves from the other side to the one side in the first direction, and control the first switching unit and the second switching unit to supply the smoke through the second supply port and suck the smoke through the first suction port, when the head moves from the one side to the other side in the first direction.

8. The printing apparatus according to claim 1, further comprising:

a carriage configured to hold the head, wherein the smoke supply unit is held by the carriage.

9. The printing apparatus according to claim 1, further comprising:

a carriage configured to hold the ultraviolet irradiation unit, wherein the smoke supply unit is held by the carriage.

10. The printing apparatus according to claim 1, wherein the smoke supply unit is provided at a position isolated from the head and the ultraviolet irradiation unit, and the smoke is supplied via a smoke supply tube.

11. A printing method of a printing apparatus comprising a head including a nozzle disposed on a nozzle surface and configured to discharge ultraviolet-curable ink onto a recording medium, an ultraviolet irradiation unit configured to irradiate the ultraviolet-curable ink discharged onto the recording medium with an ultraviolet ray, and a smoke supply unit configured to supply smoke to a part of an advancing path, from the ultraviolet irradiation unit to the nozzle surface, of an ultraviolet ray irradiated from the ultraviolet irradiation unit and entering the nozzle surface, the method comprising:

supplying the smoke from the smoke supply unit;

emitting an ultraviolet ray from the ultraviolet irradiation unit; and performing main scanning for discharging ultraviolet-curable ink from the head.

* * * * *